US006358660B1

(12) United States Patent
Agler et al.

(10) Patent No.: US 6,358,660 B1
(45) Date of Patent: Mar. 19, 2002

(54) COATED TRANSFER SHEET COMPRISING A THERMOSETTING OR UV CURABLE MATERIAL

(75) Inventors: Anne Hermetet Agler, Hawley, PA (US); Heather Reid, Hamburg, NJ (US); Scott Williams, Hawley, PA (US)

(73) Assignee: Foto-Wear, Inc., Milford, PA (US)

( * ) Notice: Subject to any disclaimer, the term of this patent is extended or adjusted under 35 U.S.C. 154(b) by 0 days.

(21) Appl. No.: 09/557,173

(22) Filed: Apr. 21, 2000

Related U.S. Application Data

(60) Provisional application No. 60/130,500, filed on Apr. 23, 1999, and provisional application No. 60/133,861, filed on May 12, 1999.

(51) Int. Cl.[7] ..... G03G 7/00; G03G 13/16; G03C 11/12; G03C 8/24

(52) U.S. Cl. ..... 430/126; 430/104; 430/138; 430/256; 430/259; 430/262; 430/263; 156/240; 428/41.8; 428/195; 428/200; 428/914; 347/105

(58) Field of Search ..... 430/259, 262, 430/263, 138, 215, 201, 200, 126, 104, 256; 428/200, 195, 41.8, 914; 347/105; 156/240

(56) References Cited

U.S. PATENT DOCUMENTS

| | | | | |
|---|---|---|---|---|
| 3,222,419 | A | 12/1965 | Jubilee et al. | |
| 3,257,478 | A | 6/1966 | Jubilee et al. | |
| 3,658,570 | A | 4/1972 | Crooks et al. | |
| 3,936,542 | A | 2/1976 | Cox | |
| 4,021,591 | A | 5/1977 | DeVries et al. | 428/200 |
| 4,189,395 | A | 2/1980 | Bland | |
| 4,235,657 | A | 11/1980 | Greenman et al. | 428/200 |
| 4,284,456 | A | 8/1981 | Hare | 428/914 |
| 4,322,467 | A | 3/1982 | Heimbach et al. | |
| 4,337,289 | A | 6/1982 | Reed et al. | 428/195 |
| 4,351,871 | A | 9/1982 | Lewis et al. | 428/195 |
| 4,477,622 | A | 10/1984 | Sanderson et al. | |
| 4,555,436 | A | 11/1985 | Geurtsen et al. | 428/200 |
| 4,726,979 | A | 2/1988 | Chapman | 428/200 |
| 4,773,953 | A | 9/1988 | Hare | |
| 4,863,781 | A | 9/1989 | Kronzer | 428/200 |

(List continued on next page.)

FOREIGN PATENT DOCUMENTS

| | | |
|---|---|---|
| EP | 0728801 A2 | 8/1996 |
| EP | 0820874 A1 | 1/1998 |
| EP | 0842787 | 5/1998 |
| FR | 2442721 | 6/1980 |
| GB | 2202641 A | 9/1988 |
| WO | WO9321561 | 10/1993 |
| WO | WO9718090 | 5/1997 |
| WO | WO9820393 | 5/1998 |
| WO | WO9821398 | 5/1998 |

OTHER PUBLICATIONS

English abstract of JP 59210978 (Nov. 29, 1984).
English abstract of JP 8324106 (Dec. 10, 1996).
English abstract of JP 2147291 (Jun. 6, 1990).
English abstract of JP 55135853 (Oct. 23, 1980).
English abstract of JP 0948974 (Sep. 22, 1997).

*Primary Examiner*—Richard L. Schilling
(74) *Attorney, Agent, or Firm*—Birch, Stewart, Kolasch & Birch, LLP

(57) ABSTRACT

A coated transfer sheet comprising a substrate having a first and second surface; at least one thermosetting and/or UV curable polymeric barrier layer overlaying said first surface, at least one release layer overlaying said at least one barrier layer; and an optional image receiving layer; wherein the coated transfer sheet exhibits cold peel, hot peel, or warm peel properties when transferred. The sheet may be imaged in electrostatic printers and copiers or imaged with other image marking techniques such as Ink Jet, conventional printing inks, thermal wax, and all craft-type markers. The resulting image may be imagewise applied to a receptor.

77 Claims, 2 Drawing Sheets

U.S. PATENT DOCUMENTS

| | | | | |
|---|---|---|---|---|
| 4,869,957 | A | 9/1989 | Vankerckhoven et al. | 428/352 |
| 4,966,815 | A | 10/1990 | Hare | 428/497 |
| 4,980,224 | A | 12/1990 | Hare | 428/202 |
| 5,019,475 | A | 5/1991 | Higashiyama et al. | 430/138 |
| 5,104,719 | A | 4/1992 | Kamen et al. | 428/195 |
| 5,139,917 | A | 8/1992 | Hare | 430/199 |
| 5,163,247 | A | 11/1992 | Weber et al. | |
| 5,236,801 | A | 8/1993 | Hare | 430/199 |
| 5,242,739 | A | 9/1993 | Kronzer et al. | 428/200 |
| 5,242,781 | A | 9/1993 | Ohbayashi et al. | 430/203 |
| 5,271,990 | A | 12/1993 | Kronzer et al. | 428/195 |
| 5,366,837 | A | 11/1994 | Saka | 430/97 |
| 5,370,132 | A | 12/1994 | Weber et al. | |
| 5,441,056 | A | 8/1995 | Weber et al. | |
| 5,501,902 | A | 3/1996 | Kronzer | 428/200 |
| 5,603,996 | A | 2/1997 | Overcash et al. | 428/219 |
| 5,612,168 | A | 3/1997 | Ishikawa | 430/138 |
| 5,620,548 | A | 4/1997 | Hare | 430/14 |
| 5,665,479 | A | 9/1997 | Oez | 428/195 |
| 5,678,247 | A | 10/1997 | Vickers | |
| 5,741,387 | A | 4/1998 | Coleman | 428/195 |
| 5,798,179 | A | 8/1998 | Kronzer | 428/200 |
| 5,882,388 | A | 3/1999 | Adair et al. | |
| 5,925,712 | A | 7/1999 | Kronzer | |

COATED TRANSFER SHEET COMPRISING A THERMOSETTING OR UV CURABLE MATERIAL

The contents of Provisional Application No. 60/130,500 filed Apr. 23, 1999 and 60/133,861 filed May 12, 1999, on which the present application is based and benefit is claimed under 35 U.S.C. 119(e) is herein incorporated by reference.

BACKGROUND OF THE INVENTION

The present invention relates to a transfer sheet comprising a barrier layer and a release layer. Further, the present invention relates to a method of transferring image areas and non-image areas of said transfer sheet to a receptor element. More specifically, the present invention relates to an image transfer paper which can be imaged in electrostatic printers and copiers or other devices in which colorant or pigment particles are imagewise applied to a substrate or which are imaged with other image marking techniques such as imaging with ink jet, conventional printing inks, thermal wax and craft-type markers, and having images which are capable of being directly transferred to, for instance, a receiver such as a textile (e.g., a shirt or the like).

Textiles such as shirts (e.g., tee shirts) having a variety of designs thereon have become very popular in recent years. Many shirts are sold with pre-printed designs to suit the tastes of consumers. In addition, many customized tee shirt stores are in the business of permitting customers to select designs or decals of their choice. Processes have also been proposed which permit customers to create their own designs on transfer sheets for application to tee shirts by use of a conventional hand iron, such as described in U.S. Pat. No. 4,244,358 issued Sep. 23, 1980. Furthermore, U.S. Pat. No. 4,773,953 issued Sep. 27, 1988, is directed to a method for utilizing a personal computer, a video camera or the like to create graphics, images, or creative designs on a fabric.

U.S. Pat. No. 5,620,548 is directed to a silver halide photographic transfer element and to a method for transferring an image from the transfer element to a receptor surface. Provisional application No. 60/029,917 (now U.S. Pat. No. 6,033,824 issued Mar. 7, 2000) discloses that the silver halide light sensitive grains be dispersed within a carrier that functions as a transfer layer, and does not have a separate transfer layer. Provisional application No. 60/056,446 (now U.S. patent application Ser. No. 09/138,553) discloses that the silver halide transfer element has a separate transfer layer. Provisional Application No. 60/065,806 (now U.S. patent application Ser. No. 09/191,373) relates to a transfer element using CYCOLOR technology, and has a separate transfer layer. Provisional Application No. 60/065,804 (now U.S. patent application Ser. No. 09/191,369) relates to a transfer element using thermo-autochrome technology, and has a separate transfer layer. Provisional application No. 60/030,933 (now U.S. patent application Ser. No. 08/970,424) relates to a transfer element using CYCOLOR and thermo-autochrome technology, but having no separate transfer layer.

U.S. Pat. No. 5,798,179 is directed to a printable heat transfer material using a thermoplastic polymer such as a hard acrylic polymer or poly(vinyl acetate) as a barrier layer, and has a separate film-forming binder layer.

U.S. Pat. No. 5,271,990 relates to an image-receptive heat transfer paper which includes an image-receptive melt-transfer film layer comprising a thermoplastic polymer overlaying the top surface of a base sheet.

U.S. Pat. No. 5,502,902 relates to a printable material comprising a thermoplastic polymer and a film-forming binder.

U.S. Pat. No. 5,614,345 relates to a paper for thermal image transfer to flat porous surfaces which contains an ethylene copolymer or a ethylene copolymer mixture and a dye-receiving layer.

U.S. Provisional Application No. 60/127,625 and U.S. application Ser. No. 09/541,083 filed Mar. 31, 2000 relate to a transfer sheet comprising a polymeric composition which in turn comprises an acrylic dispersion, an elastomeric emulsion, a plasticizer, and a water repellant. Preferably, the Barrier Layer in Ser. No. 09/541,083 is any vinyl acetate with a Tg in the range of from 0° C. to 100° C. Alternatively, the barrier layer in Ser. No. 09/541,083 is EVERFLEX G, as discussed in the preferred embodiment, with a Tg of about −7°, may be used.

U.S. Pat. No. 4,235,657 relates to a melt transfer web for transferring pre-printed inked graphic patterns onto natural or synthetic base fabric sheets comprising a crosslinking polymer-containing barrier layer.

U.S. Pat. No. 5,603,996 relates to a coated substrate sheet material for use in making containers that comprises a barrier layer that in turn comprises a cross-linkable polymer.

One problem with many known transfer sheets is that when conventional transfer materials travel through laser printers or copiers, the high temperature in the printers and copiers partially melts some polymer materials, such as a wax, present in the transfer material. As a result, the laser printer or copier must be frequently cleaned. The present invention solves this problem in the art. However, the present invention is not limited to use in laser printers and copiers.

Therefore, in order to attract the interest of consumer groups that are already captivated by the tee shirt rage described above, the present inventors provide, in one embodiment of the invention, the capability of transferring images directly to a receiver element using a material capable of holding and transferring an image. A unique advantage of the invention is to enable all consumers to wear and display apparel carrying designs that were formed on the substrate of the present invention by, for example, a photocopier, a computer printer, or by hand application (i.e., painting) in a timely and cost efficient means.

SUMMARY OF THE INVENTION

The present invention relates to a transfer sheet comprising a barrier layer and a (e.g. conventional) release layer. In one preferred embodiment, the release layer comprises a polymeric composition comprising an acrylic dispersion, an elastomeric emulsion, a plasticizer, and a water repellant. The polymeric composition of the present invention may comprise an acrylic dispersion which is an ethylene acrylic acid dispersion, the plasticizer is a polyethylene glycol, and the water repellant is polyurethane dispersion. The ethylene acrylic acid preferably melts in the range of from 65° C. to about 180° C. The elastomeric emulsion and the polyurethane dispersion have a Tg in the range of from about −50° C. to about 25° C.

The elastomeric emulsion may be selected from, for example, polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly (vinyl chloride).

The addition of elastomeric polymers and polyurethane polymers also help provide wash stability and chemical stability.

The above-described polymeric composition is useful as a release layer (i.e., transfer layer) in an imaging material.

The barrier layer of the present invention provides "cold peel," "warm peel" and "hot peel" features to the present invention. That is, the transfer material of the present invention is optionally allowed to cool after transfer to the substrate. The barrier layer of the present invention comprises thermosetting and/or ultraviolet (UV) curable polymers. The thermosetting polymers of the barrier layer set upon the addition of heat energy. UV curable polymers are typically cured initially by ultraviolet activation, then further cured by exposure to a heat source.

The imaging material of one embodiment of the present invention comprises a substrate, a barrier layer, a release layer and an optional image-receiving layer.

The imaging material of the present invention can be imaged upon using electronic means or craft-type marking. The electronic means may be, for example, electrostatic printers including but not limited to laser printers or laser copiers (color or monochromatic). In another embodiment, the invention may also be practiced with ink jet or thermal transfer printers. The present invention may also be practiced with offset printing (conventional printing) or screen printing. Further, the present invention may be practiced using craft-type markings such as, for example, markers, crayons, paints or pens.

When a laser printer or laser copier is used to image the imaging material of the present invention, the imaging material of the present invention may optionally comprise an antistatic layer, which is coated on the backside of the substrate (i.e., the side that was not previously coated with the release layer, etc.). The resulting image can be transferred to a receptor element such as a tee shirt using heat and pressure from a hand iron or a heat press.

In another embodiment of the present invention, the substrate comprises a sheet of a nonwoven cellulosic support, or polyester film support, with at least one release layer thereon comprising an acrylic dispersion, an elastomeric emulsion, a plasticizer, and a water repellent material providing an effective transfer or release layer.

In one embodiment of the invention, the substrate may, for example, be a nonwoven cellulosic support, or polyester film support, with overcoat layers such as a barrier layer of the present invention comprising a polymer to prevent the toner and release layer from adhering to the support; and a release layer to effectively transfer and release the release and optional image layer(s). The release layer preferably comprises an acrylic dispersion, an elastomeric emulsion, a plasticizer, and a water repellent material. The optional image receiving layer preferably comprises an acrylic dispersion and optional filler agents (with the purpose of modulating the surface characteristics of the invention) to facilitate the imaging of the selected marking or imaging technique (e.g. toner). One example of a commercially available substrate is a standard sheet of laser copier/printer paper such as Microprint Laser paper from Georgia Pacific.

The coated substrate is, for example, placed in a laser copier or printer (color or monochromatic) and imaged on top of the optional image receiving layer. The printed sheet is placed image side against a receptor (such as, for example, a tee shirt). Heat and pressure are applied to the non-image side of the substrate to transfer the release layer(s) and the optional image receiving layer(s). The substrate is optionally allowed to cool and then removed from the receptor.

BRIEF DESCRIPTION OF THE DRAWINGS

The present invention will become more fully understood from the detailed description given hereinbelow, and the accompanying drawings that are given by way of illustration only and thus are not limitive of the present invention, and wherein:

FIG. 3 illustrates the step of ironing the transfer element onto a tee shirt or the like.

DETAILED DESCRIPTION OF THE INVENTION

Figure 1:
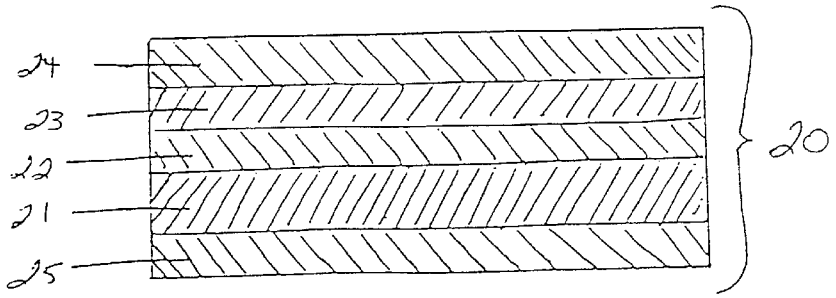
FIG. 1 is a cross-sectional view of the preferred embodiment of the transfer element of the present invention.

The present invention preferably includes an imagable transfer sheet comprising a support, a barrier layer and a release layer. The invention further relates to a method of transferring an image from the transfer sheet to a receptor element.

In one embodiment of the present invention, the Release Layer comprises a polymeric composition which in turn comprises an ethylene acrylic acid dispersion, an elastomeric emulsion, a polyurethane dispersion, and polyethylene glycol. In another embodiment of the invention, the Release Layer comprises a polymeric composition which in turn comprises an ethylene acrylic acid dispersion, a wax dispersion, and a retention aid. The polymeric composition of the release layer preferably has a melting point in the range of from 65° C. to about 180° C. However, any suitable release layer known in the art may be used.

In a preferred embodiment, the present invention comprises a substrate coated with a barrier layer, release layer, optional image receiving layers, and/or and an optional antistatic layer. Because the release layer also provides adhesion to the receptor, no separate adhesive layers are required.

A. The Transfer Material

1. Substrate

The substrate is the support material for the transfer sheet onto which an image is applied. Preferably, the substrate will provide a surface that will promote or at least not adversely affect image adhesion and image release. An appropriate substrate may include but is not limited to a cellulosic nonwoven web or film, such as a smooth surface, heavyweight (approximately 24 lb.) laser printer or color copier paper stock or laser printer transparency (polyester) film. Preferably, the substrate of the present invention is a sheet of laser copier/printer paper or a polyester film base. However, highly porous substrates are less preferred because they tend to absorb large amounts of the toner in copiers without providing as much release. The particular substrate used is not known to be critical, so long as the substrate has sufficient strength for handling, copying, coating, heat transfer, and other operations associated with the present invention. Accordingly, in accordance with some embodiments of the present invention, the substrate may be the base material for any printable material, such as described in U.S. Pat. No. 5,271,990 to Kronzer.

In accordance with other embodiments of the invention, the substrate is usable in a laser copier or laser printer. A preferred substrate for this embodiment is equal to or less than approximately 4.0 mils thick.

Since this particular substrate is useable in a laser copier or laser printer, antistatic agents may be present. The antistatic agents may be present in the form of a coating on the back surface of the support as an additional layer. The back surface of the support is the surface that is not previously coated with the release layer, barrier layer, etc.

When the antistatic agent is applied as a coating onto the back surface of the support, the coating will help eliminate copier or printer jamming by preventing the electrostatic adhesion of the paper base to the copier drum of laser and electrostatic copiers and printers. Antistatic agents, or "antistats" are generally, but not necessarily, conductive polymers that promote the flow of charge away from the paper. Antistats can also be "humectants" that modulate the level of moisture in a paper coating that affects the build up of charge. Antistats are commonly charged tallow ammonium compounds and complexes, but also can be complexed organometallics. Antistats may also be charged polymers that have a similar charge polarity as the copier/printer drum; whereby the repulsion of like charge helps prevent jamming.

Antistatic agents include, by way of illustration, derivatives of propylene glycol, ethylene oxide-propylene oxide block copolymers, organometallic complexes such as titanium dimethylacrylate oxyacetate, polyoxyethylene oxide-polyoxyproylene oxide copolymers and derivatives of cholic acid.

More specifically, commonly used antistats include those listed in the *Handbook of Paint and Coating Raw Materials*, such as t-Butylaminoethyl methacrylate; Capryl hydroxyethyl imidazoline; Cetethyl morpholinium ethosulfate; Cocoyl hydroxyethyl imidazoline Di(butyl, methyl pyrophosphato) ethylenetitanate di(dioctyl, hydrogen phosphite); Dicyclo(dioctyl)pyrophosphato; titanate; Di(dioctylphosphato) ethylene titanate; Dimethyl diallyl ammonium chloride; Distearyldimonium chloride; N,N'-Ethylene bis-ricinoleamide; Glyceryl mono/dioleate; Glyceryl oleate; Glyceryl stearate; Heptadecenyl hydroxyethyl imidazoline; Hexyl phosphate; N(β-Hydroxyethyl) ricinoleamide; N-(2-Hydroxypropyl) benzenesulfonamide; Isopropyl4-aminobenzenesulfonyl di(dodecylbenzenesulfonyl)titanate; Isopropyl dimethacryl isostearoyl titanate; isopropyltri(dioctylphosphato)titanate; Isopropyl tri (dioctylpyrophosphato)titanate; Isopropyl tri(N ethylaminoethylamino)titanate; (3-Lauramidopropyl) trimethyl ammonium methyl sulfate; Nonyl nonoxynol-15; Oleyl hydroxyethylimidazoline; Palmitic/stearic acid mono/diglycerides; PCA; PEG-36 castor oil; PEG-10 cocamine; PEG-2 laurate; PEG-2; tallowamine; PEG-5 tallowamine; PEG-15 tallowamine; PEG-20 tallowamine; Poloxamer 101; Poloxamer 108; Poloxamer 123; Poloxamer 124; Poloxamer 181; Poloxamer 182; Polaxamer 184; Poloxamer 185; Poloxamer 188; Poloxamer 217; Poloxamer 231; Poloxamer 234; Poloxamer 235; Poloxamer 237; Poloxamer 282; Poloxamer 288; Poloxamer 331; Polaxamer 333; Poloxamer 334; Poloxamer 335; Poloxamer 338; Poloxamer 401; Poloxamer 402; Poloxamer 403; Poloxamer 407; Poloxamine 304; Poloxamine 701; Poloxamine 704; Polaxamine 901; Poloxamine 904; Poloxamine 908; Poloxamine 1107; Poloxamine 1307; Polyamide/epichlorohydrin polymer; Polyglyceryl-10 tetraoleate; Propylene glycol laurate; Propylene glycol myristate; PVM/MA copolymer; polyether; Quaternium-18; Slearamidopropyl dimethyl-β-hydroxyethyl ammonium dihydrogen phosphate; Stearamidopropyl dimethyl-2-hydroxyethyl ammonium nitrate; Sulfated peanut oil; Tetra (2, diallyoxymethyl-1 butoxy titanium di(di-tridecyl)phosphite; Tetrahydroxypropyl ethylenediamine; Tetraisopropyl di(dioctylphosphito)titanate; Tetraoctyloxytitanium di(ditridecylphosphite); Titanium di(butyl, octyl pyrophosphate) di(dioctyl, hydrogen phosphite) oxyacetate; Titanium di(cumylphenylate)oxyacetate; Titanium di(dioctylpyrophosphate)oxyacetate; Titanium dimethacrylate oxyacetate.

Preferably, Marklear AFL-23 or Markstat AL-14, polyethers available from Whitco Industries, is used as an antistatic agent.

The antistatic coating may be applied on the back surface of the support by, for example, spreading a solution comprising an antistatic agent (i.e., with a metering rod) onto the back surface of the support and then drying the substrate. The present invention may use the antistatic coating disclosed in Provisional Application No. 60/127,625 filed Apr. 1, 1999 by Williams et al.

An example of a preferred substrate of the present invention is Georgia Pacific brand Microprint Laser Paper. However, any commercially available laser copier/printer paper may be used as the substrate in the present invention.

2. The Barrier Layer

The present invention is directed to the instant barrier layer, which is preferably the first coating on the substrate or support. The barrier layer also assists in releasing the optional image receiving layer and the release layer(s). The barrier layer comprises a thermosetting and/or ultraviolet (UV) curable polymer to help prevent, for instance, the image (e.g. toner) and/or Release coating from adhering to the substrate.

Thus, the barrier layer is a thermosetting and/or UV curable polymeric coating that separates the release layer from the substrate. The barrier layer is between the substrate and the release layer. Furthermore, in a preferred embodiment of the invention, the barrier layer is present as a cold, hot, or "warm" peelable coat (e.g. peels at a temperature between the normal hot peel and cold peel materials), and remains with the support after transfer of the release layer and optional image receiving layer.

Materials that fall into the class of thermosetting polymers should function as either a cool, hot or warm peel barrier layer of the present invention. Thermosetting polymers are both chemically and physically distinct from thermoplastic polymers, which, among other properties, flow upon the addition of heat energy. The fact that the thermosetting material polymerizes to form a layer which cannot be re-melted and flow with heat energy imparts both a hot and cold peel release property. That is, the thermosetting material of the barrier layer of the present invention will not undergo a temperature dependent physical state change which can produce, among other properties, a tack that could provide a physical adherence of the release layer to the support base.

Thermosetting materials include thermosetting acrylic polymers and blends, such as hydroxyl-functional acrylic polymers and carboxy-functional acrylic polymers and vinyl acrylic polymer blends; thermosetting polyurethanes, block polyurethanes and aromatic-functional urethanes; thermosetting polyester polymers and co-polymer systems such as neopentyl glycol isophthalic polyester resins, dibromoneopentyl glycol polyester resins and vinyl ester resins; aromatic-functional vinyl polymers and polymer blends; and thermosetting epoxy resins, in particular, epoxy novolac resins. Generally, the thermosetting polymer system(s) must undergo crosslinking reaction(s) over a range of temperatures from ambient (e.g. 190°) to 250° C. over a period of less than thirty (30) minutes.

Other materials which may be used in the barrier layer of the present invention include formulations based on polyethylene terephthalate (PET) and its derivatives. PET is a well known polyester based resin that is water dispersible, film forming and imparts strong water resistance and hydrophobicity upon drying.

Derivatives of PET are well known in the art. For instance, derivatives of polyethylene terephthalates (PET)

that could potentially be used in the barrier layer of a thermal transfer sheet will be discussed in two very general categories: copolymers of PET and reaction products of PET and various other compounds. The first of these categories, copolymers of PET, includes copolymers of PET and other polymeric materials. The second category, reaction products of PET, preferably post-consumer PET, with other compounds, includes known reaction products of PET.

Copolymers of PET that may be useful in the instant barrier layer for a thermal transfer sheet include, but art not limited to: PET/polyolefin copolymers, PET/polyether copolymers, PET/polyester copolymers, PET/polyurethane copolymers, PET/polysiloxane copolymers, PET/vinylacetate copolymers, PET/polyacetate copolymers, PET/ethylenevinyl acetate copolymers, PET/polyamide copolymers, PET/ethylene acrylic acid copolymers, PET/polyacrylate copolymers, PET/polyvinyl chloride copolymers, PET/styrene butadiene copolymers, PET/polyethylene naphthalate copolymers, PET/polystyrene copolymers, PET/acrylonitrile-butadiene copolymers, PET/styrene-butadiene-styrene copolymers, PET/acrylonitirle-butadiene-styrene copolymers, PET/acrylonitrile-ethylene-styrene copolymers, PET/polychloroprene copolymers, PET/polyvinyl acetate copolymers, PET/polyisoprene copolymers, PET/poly(ethyl acrylate) copolymers, PET/polymethacrylate copolymers, PET/polyacrylonitrile copolymers, PET/polyvinyl pyrrolidone copolymers, PET/polyacrylamide copolymers, PET/polyester polycarbonate copolymers, and PET/polyol copolymers.

A number of reaction products of PET (in either pre-consumer, post-consumer, virgin, recycled, or precursor raw form) and various different compounds have been cited in the patent literature. It is important to understand that often times the resultant material formed has not been identified as anything other than "the reaction product of PET and . . . " Often this is because of the complexity of the materials formed which sometimes eliminates the possibility to identify a single, simple reaction product. For clarity, examples are discussed below.

The reaction product of PET and polycarboxylic acid or anhydride, especially compounds from the group consisting of trimellitic anhydride, trimellitic acid, and maleic anhydride. The most relevant example of this type of reaction is discussed in U.S. Pat. No. 5,858,551 to Salsman.

The synthesis of sulfonated polyester resins from PET is described by Salsman in U.S. Pat. No. 5,820,982 and U.S. Pat. No. 5,281,630.

Reaction products of glycols and PET have been reported in great number in the patent literature. In addition, many of these reaction products undergo further chemistry in order to exploit all of their potential uses, as described in a number of the patents. Examples of PET/glycol reaction products include Trowell: U.S. Pat. No. 4,720,571; Brennan, et al: U.S. Pat. No. 4,506,090; Fisher: U.S. Pat. Nos. 5,932,666, 5,756,554, 5,552,478; and Salsman: U.S. Pat. Nos. 5,726,277 and 4,977,191.

Reaction products of amines and diamines with PET have been described by Nakano in U.S. Pat. No. 5,827,803 and by Speranza et al. in U.S. Pat. No. 4,503,197.

Products of the reaction of alcohols with PET have been described in the literature. Rao et al. describe catalyzed reactions of alcohols with PET in U.S. Pat. No. 5,252,615. Jhaveri gives an example of uncatalyzed reactions of alcohols with PET in U.S. Pat. No. 5,698,613.

Sayre et al. gives an example of reaction products of PET and acid anhydrides, also known as the acidolysis of PET, in U.S. Pat. No. 5,371,112.

Examples of reaction products of trimellitic acid polyester ether and PET are given by Bathe in U.S. Pat. Nos. 5,068,395 and 5,008,366.

Aromatic ester polyols can be produced by the digestion of post-consumer PET with low molecular weight aliphatic polyols as described by Altenberg and de Jong in U.S. Pat. No. 4,701,477.

Examples of the synthesis of polyols and polyester-polyols from PET has been described by DeLeon and Shieh in U.S. Pat. No. 5,360,099 and by Hallmark et al. in U.S. Pat. No. 4,873,268. Polyols of these types have been further reacted to form polyurethane and polyisocyanurate foams (Trowell U.S. Pat. No. 4,720,571 and Brennan et al. U.S. Pat. No. 4,506,090), aromatic polyester polycarbonates (Yeakey et al. U.S. Pat. No. 4,468,483), and many other useful polymeric compounds.

Although incorporation of other components into the barrier layer may be desired for certain applications, PET is preferably used as it is provided by the supplier or in aqueous dilutions thereof. Suitable PET materials that may be used in the present invention are available from EvCo Research, Inc., Atlanta, Ga., USA, as EvCote PWR-25. See also U.S. Pat. No. 5,858,551. EvCote PWR-25 is a 25% aqueous dispersion of post-consumer PET and is known to crosslink with the addition of heat at about 100° C. Upon crosslinking, it is a thermoset polymer. Crosslinking of EvCote PWR-25 is dependent upon time, air flow, surface area and temperature. Representative formulations for barrier layers using EvCote PWR-25 are shown in Example 25.

Preferred barrier materials include the following materials available from the EvCo Research Company (PET and PET derivatives).

Barrier Formulas (thermosetting)

1. 100 parts Evcote PWR-25
2. 100 parts EvCote PWRH-25
3. 100 parts EvCote PGLR-25

Optional Sizing Agent 1. 100 Parts PBC-50

All above listed barrier formulas 1–3 are preferably coated onto a support using a #10 Metering Rod. Desirable coat weights include a range of between 0.5 and 15 g/m$^2$, preferring 1 to 7 g/m$^2$. Upon coating of the Barrier Formulation, the coating is (e.g. oven) cured for between about 10 and 120 seconds above about 100° C.

An optional crosslinking agent can be added to each formula to increase crosslinking speed upon activation by air flow and temperature. Crosslinkers suited for this application include, but are not limited to, aziridine (ie., Ionac PFAZ-322), aziridine derivatives, melamine (i.e., Cymul 323 EvCo, Inc.), and organometallics like an organic titanate such as Tyzor LA (DuPont).

An optional sizing agent may be applied prior to application of the Barrier Formulation. The optional sizing agent functions by decreasing the porosity present in the support used, and by masking the Barrier Formulation from starch sizing agents found in many non-woven cellulosic supports. Therefore, EvCo PBC-50 can be applied on the paper machine during manufacturing as a paper sizing. If using PBC-50 as a sizing agent, it may optionally be applied to the substrate initially, prior to coating the Barrier Layer. When coated onto pre-supplied paper, a #10 Metering Rod has been proven effective in decreasing porosity and proving adequate coverage to the base.

Coating weights (e.g. of the barrier layer) may range from one (1) gram per meter square to 20 grams per meter square, preferably from 1 g/m$^2$ to 15 g/m$^2$, most preferably 1 g/m$^2$ to g/m$^2$.

The Barrier Layer also may optionally include an effective amount of a release-enhancing additive for assisting in release of the release layer from the barrier during peeling, such as a divalent metal ion salt of a fatty acid, a polyethylene glycol, or a mixture thereof. The release-enhancing additive may be present in an amount of from 0.1 to 40% by weight, preferably 0.1 to 20% by weight, most preferably 0.1 to 10% by weight.

For example, the release-enhancing additive may be calcium stearate, a polyethylene glycol having a molecular weight of from about 2,000 to about 100,000, or a mixture thereof. For a description of suitable thermosetting polymers, see pages 10 to 13 of *Polymer Chemistry, an Introduction*, Malcolm P. Stevens, 1990; and pages 113 and 299 of *Textbook of Polymer Science*, Fred W. Billmeyer, Jr., 1962.

In addition to the above-described thermosetting polymers ultraviolet curable/setting materials may be used as the barrier layer of the present invention. UV setting materials can be divided into two classes based upon the mechanism by which they set. The first class of ultraviolet curing/setting materials set via a cationic mechanism while the second class sets via a free radical mechanism. It is important to note, however, that a number of ultraviolet curing systems incorporate both classes into a single formulation, typically termed a hybrid resin system. In one embodiment of the present invention, the ultraviolet curing system, especially when comprising cationic systems, may incorporate thermosetting polymers, thereby resulting in systems that typically are cured initially by ultraviolet activation, then further cured by exposure to a heat source. In such an embodiment, the final coated surface has the best properties of both thermosetting and ultraviolet setting systems. As a consequence of such multiple pathways to create the final cured coating, the ultraviolet setting compounds to be listed herein may be activated by any combination of the mechanisms described herein. Furthermore, the thermosetting or UV curable barrier layer of the present invention may be combined with at least one vinyl acetate polymer. One of ordinary skill in the art would recognize the appropriate mechanism or mechanisms by which to activate a specific formulation of ultraviolet curing compounds and formulations that include both ultraviolet curing compounds and thermosetting compounds.

Typical formulations of ultraviolet curable systems are composed of primary resins, which provide the major film-forming properties; modifying resins, which modify the film properties to meet specifications for the application in which it is to be used; additives, which provide or enhance specific properties of the film; and photoinitiators which, when exposed to an ultraviolet radiation source, begin the cross-linking reaction that cures the system. The UV curable polymers of the present invention are typically cured at <50 $mJ/cm^2$ with a mercury vapor ultraviolet lamp.

Primary and modifying resins are discussed as a single class as they often cross over from one application to the next. These ultraviolet curable resins include, but are not limited to monomers and oligomers. Monomers such as monofunctional monomers including acrylates, methacrylates, and ethylacrylates; difunctional monomers including various diacrylates and dimethacrylates, especially tripropylene glycol diacrylate, bisphenol A diacrylates and ethoxylated bisphenol A dimethacrylates; trifunctional monomers including various triacrylates and trimethacrylates, especially trimethylolpropane ethoxy triacrylate and trimethyl propane triacrylates; higher functionality monomers including tetra- and pentaacrylates and pentaacrylate esters; aliphatic and aromatic acrylates; aromatic urethane acrylates; metallic acrylates; water dispersible monomers such as, for example, 2(2-ethoxyethoxy) ethylacrylate and polyethylene glycol diacrylates; adhesion promoting monomers such as various acrylate esters and methacrylate esters; pigment dispersing monomers; and scorch retarding monomers.

Oligomers such as aliphatic urethane acrylates; aliphatic urethane diacrylates; aliphatic urethane triacrylates; hexafunctional aliphatic urethane acrylates; hexafunctional aromatic urethane acrylates; trifunctional aromatic urethane acrylates, aromatic urethane acrylates; urethane methacrylates; epoxy acrylates; epoxy methacrylates; polybutadiene dimethylacrylates; diacrylates of bisphenol-A epoxy resins; modified bisphenol-A epoxy acrylate resins; novolac epoxy acrylates; modified epoxy acrylates, partially acrylated bisphenol-A epoxy resins; bisphenol-A epoxy diacrylates; polyester resins including chlorinated polyester resins, modified polyester resins, polyester methacrylates, acrylated polyesters, modified polyester acrylates, modified polyester hexaacrylates, polyestertetracrylates, and hexafunctional polyester acrylates; cycloaliphatic epoxideresins, especially 3,4-epoxycyclohexyl-methyl-3,4,-epoxycyclohexame carboxylate; modified cycloaliphatic epoxides, especially acrylate modified cycloaliphatic epoxides containing both acrylate and epoxy functionalities; aliphatic polyols; partially acrylated bisphenol-A epoxy resins; and cycloaliphatic diepoxides.

Photoinitiators for the ultraviolet curable systems include, but are not limited to alpha hydroxy ketone; benzil dimethyl ketal; benzoin normal butyl ethers; benzophenone; modified benzophenones; polymeric hydroxy ketones; trimethylbenzophenone blends; sulfonium, iodonium, ferrocenium or diazonium salts, especially cyclic 1,2-propylene carbonate bis-p-diphenylsulfoniumphenylsulfide hexafluorophosphate, and diphenylsulfonium hexafluorophosphate; peroxides; cobaloximes and related cobalt (II) complexes; and organic photoinitiators such as, for example, 2,2-diethoxyacetophenone, ethyl 4-(dimethylamino)benzoate, methyldiethanolamine, isopropylthioxanthone, and especially 2-hydroxy-2-methyl-1-phenyl-1-propanone.

Additives that may be used in the above-described ultraviolet curable systems include, but are not limited to photoinitiator activators; slip agents; leveling agents; wetting agents; adhesion promoters; anti-absorption agents; anti-foaming agents, especially mixtures of foam destroying polymers and polysiloxanes; accelerators; pigment dispersion aids; anti-blocking agents; anti-caking agents; anti-slip agents; anti-skinning agents; anti-static agents; anti-stripping agents; binders; curing agents; crosslinking agents; deaerators; diluents; dispersants; dryers; emulsifiers; fillers; flatting agents; flow control agents; gloss agents; hardeners; lubricants; mar resistance aids; whiteners; plasticizers; solvents; stabilizers; surfactants; viscosity modifiers; UV stabalizers; UV absorbers; and water repellants. The barrier layer of the present invention may also comprise the cross-linking polymers of U.S. Pat. No. 5,603,996 to Overcash et al. Specifically, see Overcash et al. at cols. 5–8.

That is, the barrier coating composition for the coated transfer sheet may comprise an acrylic polymer, or resin, as a cross-linkable polymer. Additional cross-linkable acrylic polymers include MICHEM COAT 50A, made by Michelman, Inc., and RHOPLEX.RTM. P-376 and RHOPLEX.RTM. B-15, made by Rohm and Haas. In addition, styrene-butadiene resins, or polymers, ("SBR") are suitable as cross-linkable polymers in the barrier coating composition, including such SBR's as MICHEM COAT 50H, made by Michelman, Inc., and Latex PB 6692NA made by Dow Chemical. Blends and/or copolymers of cross-linkable polymers may also be used. Other cross-linkable polymers, such as polyurethane polymers and various fluorochemical polymers (e.g., 3B ZONYL.RTM. 7040 made by Du Pont), may also provide the necessary barrier properties.

A more specific listing of polymers that may be used as cross-linkable polymers includes, but is not limited to:

polymers and copolymers of poly(dienes) such as poly (butadiene), poly(isoprene), and poly(1-penetenylene);

poly(acrylics) such as poly(benzyl acrylate), poly(butyl acrylate) (s), poly(2-cyanobutyl acrylate), poly-(2-ethoxyethyl acrylate), poly(ethyl acrylate), poly(2-ethylhexyl acrylate), poly(fluoromethyl acrylate), poly (5,5,6,6,7,7,7-heptafluoro-3-oxaheptyl acrylate), poly (heptafluoro-2-propyl acrylate), poly(heptyl acrylate), poly(hexyl acrylate), poly(isobornyl acrylate), poly (isopropyl acrylate), poly(3-methoxybutyl acrylate), poly(methyl acrylate), poly(nonyl acrylate), poly(octyl acrylate), poly(propyl acrylate), and poly(p-tolyl acrylate);

poly(acrylamides) such as poly(acrylamide), poly(N-butylacrylamide), poly(N,N-dibutylacrylamide), poly (N-dodecylacrylamide), and poly(morpholyl-acrylamide);

poly(methacrylic acids) and poly(methacrylic acid esters) such as poly(benzyl methacrylate), poly(octyl methacrylate), poly(butyl methacrylate), poly(2-chloroethyl methacrylate), poly(2-cyanoethyl methacrylate), poly(dodecyl methacrylate), poly(2-ethylhexyl methacrylate), poly(ethyl methacrylate), poly(1,1,1-trifluoro-2-propyl methacrylate), poly(hexyl methacrylate), poly(2-hydroxyethyl methacrylate), poly(2-hydropropyl methacrylate), poly(isopropyl methacrylate), poly(methacrylic acid), poly(methyl methacrylate) in various forms such as, atactic, isotactic, syndiotactic, and heterotactic; and poly (propyl methacrylate);

poly(methacrylamides) such as poly(4-carboxy phenylmethacrylamide);

other alpha-and beta-substituted poly(acrylics) and poly (methacrylics) such as poly(butyl chloracrylate), poly (ethyl ethoxycarbonylmethacrylate), poly(methyl fluoroacrylate), and poly(methyl phenylacrylate);

poly(vinyl ethers) such as poly(butoxyethylene), poly (ethoxyethylene), poly(ethylthioethylene), (dodecafluorobutoxyethylene), poly poly(2,2,2-trifluoroethoxytrifluoroethylene), poly (hexyloxyethylene), poly(methoxyethylene), and poly (2-methoxypropylene);

poly(vinyl halides) and poly(vinyl nitriles) such as poly (acrylonitrile), poly(1,1-dichloroethylene), poly (chlorotrifluoroethylene), poly(1,1-dichloro-2-fluoroethylene), poly(1,1-difluoroethylene), poly (methacrylonitrile), poly(vinyl chloride), and poly (vinylidene chloride);

poly(vinyl esters) such as poly(vinyl acetate), poly (benzoyloxyethylene), poly(4-butyryloxybenzoyloxyethylene), poly(4-ethylbenzoyloxyethylene), poly[(trifluoroacetoxy)ethylene], poly [(heptafluorobutyryloxy)ethylene], poly (formyloxyethylene), poly[(2-methoxybenzoyloxy) ethylene], poly(pivaloyloxyethylene), and poly (propionyloxyethylene);

poly(styrenes) such as, poly(4-acetylstyrene), poly[3-(4-biphenylyl)styrene], poly(4-[(2-butoxyethoxy) methyl] styrene), poly(4-butoxymethyl styrene), poly(4-butoxystyrene), poly(4-butylstyrene), poly(4-chloro-2-methylstyrene), poly(2-chlorostyrene), poly(2,4-dichlorostyrene), poly(2-ethoxymethyl styrene), poly (4-ethoxystyrene), poly(3-ethylstyrene), poly(4-fluorostyrene), poly(perfluorostyrene), poly(4-hexylstyrene), poly [4-(2-hydroxyethoxymethyl) styrene], poly [4-(1-hydroxy-1-methylpropyl)styrene], poly(2-methoxymethylstyrene), poly(2-methoxystyrene), poly(alpha-methylstyrene), poly(2-methylstyrene), poly(4-methoxystyrene), poly(4-octanoylstyrene), poly(4-phenoxystyrene), poly(4-phenylstyrene), poly(4-propoxystyrene), and poly (styrene);

poly(oxides) such as poly(ethylene oxides), poly (tetrahydrofuran), poly(oxetanes), poly(oxybutadiene), poly[oxychloromethyl)ethylene], poly(oxy-2-hydroxytrimethyleneoxy-1,4-phenylenemethylene-1,4-phenylene), poly(oxy-2,6-dimethoxy-1,4-phenylene), and poly(oxy-1,3-phenylene);

poly(carbonates) such as polycarbonate of Bisphenol A, and poly[oxycarbonyloxy-4,6-dimethyl]-1,2-phenylenemethylene-3,5-dimethyl-1,2-phenylene];

poly(esters) such as poly(ethylene terephthalate), poly[(1,2-diethoxycarbonyl)ethylene], poly[(1,2-dimethoxycarbonyl)ethylene], poly(oxy-2-butenyleneoxysebacoyl), poly[di(oxyethylene) oxyadipoyl], poly(oxyethyleneoxycarbonyl-1,4-cyclohexylenecarbonyl), poly(oxyethyleneoxy-isophthaloyl), poly[di(oxyethylene)oxyoxalyl], poly[di (oxyethylene)oxysuccinyl], poly(oxyethyleneoxy-terephthaloyl), poly(oxy-1,4-phenyleneisopropyiidene-1,4-phenylene oxysebacoyl), and poly(oxy-1,3-phenyleneoxyisophthaloyl);

poly(anhydrides) such as poly(oxycarbonyl-1,4-phenylenemethylene-1,4-phenyl enecarbonyl), and poly(oxyisophthaloyl);

poly(urethanes) such as poly(oxycarbonyl-iminohexamethyleneiminocarbonyloxydecamethylene), poly(oxyethyleneoxycarbonyliminiohexamethylene-iminocarbonyl), poly(oxyethyleneoxycarbonylimino-1,4-phenylenetrimethylene-1,4-phenyleneim inocarbonyl), poly(oxydodecamethyleneoxycarbonyl-iminodecamethyleneiminocar bonyl), and poly (oxytetramethyleneoxycarbonylimino-1,4-phenylenemethylene-1,4-phenyleneiminocarbonyl);

poly(siloxanes) such as, poly(dimethylsiloxane), poly [oxy(methyl)phenylsilylene], and poly (oxydiphenylsilylene-1,3-phenylene);

poly(sulfones) and poly(sulfonamides) such as poly [oxycarbonyl di(oxy-1,4-phenylene)sulfonyl-1,4-phenyleneoxy-1,4-phenylene], poly[oxy-1,4-phenylenesulfinyl-1,4-phenyleneoxy-1,4-phenylenecarbonyl-1,4-phenylene), poly(oxy-1,4-phenylenesulfonyl-1,4-phenylene), and poly(sulfonyl-1,3-cyclohexylene);

poly(amides) such as nylon-6, nylon-6,6, nylon-3, nylon-4,6, nylon-5,6, nylon-6,3, nylon-6,2, nylon-6,12, and nylon-12;

poly(imines) such as poly(acetyliminoethylene), and poly (valeryl iminoethylene);

poly(benzimidazoles) such as poly(2,6-benzimidazolediyl-6,2-benzimidazolediyloctamethylene);

carbohydrates such as amylose triacetate, cellulose triacetate, cellulose tridecanoate, ethyl cellulose, and methylcellulose;

and polymer mixtures and copolymers thereof such as poly(acrylonitrile-co-styrene) with poly(e-caprolactone), or poly(ethyl methacrylate), or poly (methyl methacrylate);

poly (acrylonitrile-co-vinylidene chloride) with poly (hexamethylene terephthalate);

poly (allyl alcohol-co-styrene) with poly(butylene adipate), or poly(butylene sebacate); poly(n-amyl methacrylate) with poly(vinyl chloride);

bisphenol A polycarbonate with poly(e-caprolactone), or poly(ethylene adipate), or poly(ethylene terephthalate), or novolac resin;

poly(butadiene) with poly(isoprene);

poly(butadiene-co-styrene) with glycerol ester of hydrogenated rosin;

poly(butyl acrylate) with poly(chlorinated ethylene), or poly(vinyl chloride);

poly(butyl acrylate-co-methyl methacrylate) with poly (vinyl chloride);

poly(butyl methacrylate) with poly(vinyl chloride);

poly(butylene terephthalate) with poly(ethylene terephthalate), or poly(vinyl acetate-co-vinylidene chloride);

poly(e-caprolactone) with poly(chlorostyrene), or poly (vinyl acetate-co-vinylidene chloride);

cellulose acetate with poly(vinylidene chloride-co-styrene);

cellulose acetate-butyrate with poly(ethylene-co-vinyl acetate);

poly(chlorinated ethylene) with poly(methyl methacrylate);

poly(chlorinated vinyl chloride) with poly(n-butyl methacrylate), or poly(ethyl methacrylate), or poly (valerolactone);

poly(chloroprene) with poly(ethylene-co-methyl acrylate);

poly(2,6-dimethyl-1,4-phenylene oxide) with poly(a-methylstyrene-co-styrene styrene), or poly(styrene);

poly(ethyl acrylate) with poly(vinyl chloride-co-vinylidene chloride), or poly(vinyl chloride);

poly(ethyl methacrylate) with poly(vinyl chloride);

poly(ethylene oxide) with poly(methyl methacrylate);

poly(styrene) with poly(vinyl methyl ether); and poly(valerolactone) with poly(vinyl acetate-co-vinylidene chloride).

In a preferred embodiment of the invention, the barrier layer is a cationic UV cured/thermoset hybrid system. Barrier Layer Formulation 1 is an example of such a hybrid system. Barrier Layer Formulation 1 comprises a cycloaliphatic epoxide, optional cycloaliphatic epoxide resin, epoxy novolac resin, optional alcohol, activated epoxy, aryl ketone, optional polyacrylate, and optional polysiloxane.

The barrier layer in the present invention has essentially no tack at transfer temperatures from 60° to 220°. Additionally, there are no primary or secondary changes of state upon heating that would alter the physical characteristics (such as, for example, surface residue) upon transfer. Additionally, the barrier layer of the present invention preferably transfers no residue to the transferred image. The barrier layer of the present invention allows efficient conduction of heat to the release layer and for water based colorants, the barrier layer preferably provides a water barrier that helps prevent penetration of the substrate.

An additional embodiment of the barrier layer of the present invention is 100 parts (by weight) Polyester Resin (Polylite 32-737; Reichhold, Inc.). The polyester coating is applied with a dry coat weight of from 1 to 20 g/m$^2$, preferably 1–15 g/m$^2$ and most preferably 1–8 g/m$^2$. Coating methods include gravure, metered rod, air knife, cascade, etc. Coatings are cured by exposure to thermal energy that ranges from 30° C. to 250° C., preferably 70° C. to 200° C., and most preferably 100° to 170° C. Curing times range from 10 seconds to 20 minutes, preferably from 1 minute to 18 minutes, most preferably from 8 minutes to 15 minutes.

3. The Release Layer

The release layer is positioned between the barrier layer and an optional image receiving layer, or simply located on top of the barrier layer. The release layer of the present invention transfers with the image from the substrate/barrier to the desired receptor. That is, the release layer of the present invention must provide the properties to effectively transfer the release layer and any images and/or optional layers thereon. Further, the release layer must also provide for adhesion of the release layer and the optional image receiving layer to the receptor without the requirement of a separate surface adhesive layer. Such release layers are known in the art and may be used with the barrier layer of the invention. For instance, note the release layers in several of the publications/applications discussed in the Background section of this application. The release layer is preferably prepared from, for example, a coating composition comprising a film forming binder (e.g. acrylic dispersion), an elastomeric emulsion, a plasticizer, and a water repellant. The water repellant may comprise, for example, polyurethane for the purpose of providing water resistance for toner retention and/or a retention aid. Preferably, the film forming binder melts in the range of 65 to 180° C.

Without being bound by any theory, upon back surface heating of the substrate, the release layer would undergo a solid to solution phase transition resulting in the transfer of the release layer and image and non-image areas and any optional layers to the receptor. Edge to edge adhesion to the receptor occurs upon cooling of the release layer onto the receptor. The image receiving layer, image and any optional layers thereon are transferred onto the receptor and the substrate removed, leaving the image adhered to the receptor. If coatings are still hot upon removal, this is known as a "hot peel" product. If the coatings are at room temperature upon removal, the product is known as a "cold peel" product. If the coatings are at a temperature above room temperature but below the transfer temperature, the product is a "warm peel" product. The release layer of the present invention protects any transferred image, provides mechanical and thermal stability, as well as washability, preferably without losing the flexibility of the textile. That is, the release layer should also provide a colorfast image (e.g. washproof or wash resistant) when transferred to the receptor surface. Thus, upon washing the receptor element (e.g. tee shirt), the image should remain intact on the receptor.

Further, the release layer satisfies the requirement for compatible components, in that the component dispersions remain in their finely dispersed state after admixture, without coagulating or forming clumps or aggregated particles which would adversely affect image quality. Additionally, the release layer is preferably non-yellowing.

The release layer has a low content of organic solvents, and any small amounts present during the coating process are sufficiently low as to meet environmental and health requirements. More specifically, the release layer preferably has a content of organic solvents of less than 2% weight by weight of components. More preferably, the release layer has a content of organic solvents of less than 1% weight by weight of components. various additives may be incorporated into the release layer or the barrier and/or image receiving layer(s). Retention aids, wetting agents, plasticizers and water repellants are examples. Each will be discussed in turn, below.

Retention Aids

An additive may be incorporated for the purpose of aiding in the binding of the applied colorant such as water-based ink jet colorants and/or dry or liquid toner formulations. Such additives are generally referred to as retention aids. Retention aids that have been found to bind colorants generally fall into three classes: silicas, latex polymer and polymer retention aids. Silicas and silicates are employed when the colorant is water-based such as ink jet formulations. An example of widely used silicas are the Ludox (DuPont) brands. Polyvinyl alcohol represents as class of polymers that have also been applied to the binding of ink jet dyes. Other polymers used include anionic polymers such as Hercobond 2000 (Hercules). Reten 204LS (Hercules) and Kymene 736 (Hercules) are catonic amine polymer-epichlorohydrin adducts used as retention aids. Latex polymers include, by way of illustration, vinyl polymers and vinyl co-polymer blends such as ethylene-vinyl acetate, styrene-butadiene copolymers, polyacrylate and other polyacrylate-vinyl copolymer blends. The retention aids are present in an amount of from 0.1 to 40% by weight, preferably 0.1 to 20%, more preferably from 0.1 to 10%.

Wetting Agents and Rheology Modifiers

Wetting agents, rheology modifiers and surfactants may also be included in the Release Layer. Such agents may either be nonionic, cationic or anionic. The surfactant selected should be compatible with the class of polymers used in a formulation. For example, anionic polymers require the use of anionic or non-ionic wetting agents or surfactants. Likewise, cationic surfactants are stable in polymer solution containing cationic or non-ionic polymers. Examples of surfactants or wetting agents include, by way of illustration, alkylammonium salts of polycarboxylic acid, salts of unsaturated polyamine amides, derivatives of nonoxynol, derivatives of octoxynols (Triton X-100 and Triton X-114 (Union Carbide), for example), dimethicone copolymers, silicone glycol copolymers, polysiloxane-polyether copolymers, alkyl polyoxy carboxylates, tall oil fatty acids, ethylene oxide-propylene oxide block copolymers and derivatives of polyethylene glycol. The wetting agents, rheology modifiers and surfactants may be present in an amount of from 0.1 to 40% by weight, preferably 0.1 to 20%, more preferably from 0.1 to 10%.

Viscosity modifiers may also be included. Generally, various molecular weight polyethylene glycols are incorporated to serve this purpose. Polyethylene glycols used generally range in molecular weight from 100 to 500,000 with molecular weights between 200 and 1000 being the most useful in this application. The viscosity modifiers may be present in an amount of from 0.1 to 40% by weight, preferably 0.1 to 20%, more preferably from 0.1 to 10%.

Plasticizers

Plasticizers may be included in order to soften hard polymer and polymer blend additions. Plasticizers used include polyethylene glycol, and by way of illustration, aromatic derivatives such as di-octyl phthalate, di-decyl phthalate derivatives and tri-2-ethylhexyl trimellitate. Aliphatic plasticizers include derivatives of ethylhexyl adipates and ethylhexyl sebacates. Epoxidized linseed or soya oils may also be incorporated but generally are not used due to yellowing and chemical instability upon heat application. The plasticizers may be present in an amount of from 0.1 to 40% by weight, preferably 0.1 to 20%, more preferably from 0.1 to 10%.

Water Repellants

Water repellant aids may also be incorporated into order to improve the wash/wear resistance of the transferred image. Examples of additives include polyurethanes, wax dispersions such as carnauba wax, mineral waxes, montan wax, derivatives of montan wax, petroleum waxes, synthetic waxes such as polyethylene and oxidized polyethylene waxes, hydrocarbon resins, amorphous fluoropolymers and polysiloxane derivatives. Water repellants may be present in an amount of from 0.1 to 40% by weight, preferably 0.1 to 20%, more preferably from 0.1 to 10%.

Particularly when the imaging method is a laser printer or copier, the release layer of the present invention preferably excludes wax dispersions derived from, for example, a group including but not limited to natural waxes such as carnauba wax, mineral waxes, montan wax, derivatives of montan wax, petroleum waxes, and synthetic waxes such as polyethylene and oxidized polyethylene waxes. If the imaging method used is a nonlaser printer/copier method it is not necessary to preferably exclude waxes from use in the transfer material. However, the amount of waxes that may be present in the transfer material of the invention when intended for use in laser printers or copiers must be sufficiently low as to avoid adverse affects on copier or printer operation. That is, the amount of wax present must not cause melting in the printer or copier.

The above properties make this release layer highly suited for compatibilizing the stringent requirements of the electrostatic imaging process with the requirements of heat transfer image technology to provide a product having good image quality and permanence under the demanding conditions of textile application, wear and wash resistance in use, and wash resistance such that the image adhesion to the receptor element is maintained. The release layer is preferably a polymeric coating designed to provide a release from the substrate and adherence to a receptor when heat is applied to the back of the substrate.

Suitable examples of the release layers of the invention are exemplified below.

In the most preferred embodiment of the invention (Release Layer Formulation 1), the release layer comprises an ethylene acrylic acid co-polymer dispersion, an elastomeric emulsion, a polyurethane dispersion and polyethylene glycol.

The acrylic dispersion is present in a sufficient amount so as to provide adhesion of the release layer and image to the receptor element and is preferably present in an amount of from 46 to 90 weight %, more preferably 70 to 90 weight % based on the total composition of the release layer.

The elastomeric emulsion provides the elastomeric properties such as mechanical stability, flexibility and stretchability, and is preferably present in an amount of from 1 to 45 weight %, more preferably 1 to 20 weight % based on the total composition of the release layer.

The water repellant provides water resistance and repellency, which enhances the wear resistance and washability of the image on the receptor, and is preferably present in an amount of from 1 to 7 weight %, more preferably 1 to 6 weight % based on the total composition of the release layer.

The plasticizer provides plasticity and antistatic properties to the transferred image, and is preferably present in an amount of from 1 to 8 weight %, more preferably 2 to 7 weight % based on the total composition of the release layer.

Preferably, the acrylic dispersion is an ethylene acrylic acid co-polymer dispersion that is a film-forming binder that provides the "release" or "separation" from the substrate. The release layer of the invention may utilize the film-forming binders of the image-receptive melt-transfer film layer of U.S. Pat. No. 5,242,739, which is herein incorporated by reference.

Thus, the nature of the film-forming binder is not known to be critical. That is, any film-forming binder can be employed so long as it meets the criteria specified herein. As a practical matter, water-dispersible ethylene-acrylic acid copolymers have been found to be especially effective film forming binders.

The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover, the melting points or softening points described are better indicators of performance than the chemical nature of the polymer or binder.

Representative binders (i.e., acrylic dispersions) for release from the substrate are as follows:

Binder A

Binder A is Michem® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 pas (650 centipoise) at 140° C.

Binder B

This binder is Michem® Prime 4983R (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Binder D

This binder is Michem® 37140, a 40 percent solids dispersion of a Hoechst-Celanese high density polyethylene. The polymer is reported to have a melting point of 100° C.

Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Binder F

Binder F is Michem® 48040, an emulsion of an Eastman Chemical Company microcrystalline wax having a melting point of 88° C. The supplier is Michelman, Inc., Cincinnati, Ohio.

Binder G

Binder G is Michem® 73635M, an emulsion of an oxidized ethylene-based polymer. The melting point of the polymer is about 96° C. The hardness is about 4–6 Shore-D. The material is supplied by Michelman Inc., Cincinnati, Ohio.

The second component of Release Layer Formulation 1 is an elastomeric emulsion, preferably a latex, and is compatible with the other components, and formulated to provide durability, mechanical stability, and a degree of softness and conformability to the layers.

Films of this material must have moisture resistance, low tack, durability, flexibility and softness, but with relative toughness and tensile strength. Further, the material should have inherent heat and light stability. The latex can be heat sensitized, and the elastomer can be self-crosslinking or used with compatible cross-linking agents, or both. The latex should be sprayable, or roll stable for continuous runnability on nip rollers.

Elastomer latexes of the preferred type are produced from the materials and processes set forth in U.S. Pat. Nos. 4,956,434 and 5,143,971, which are herein incorporated by reference. This curable latex is derived from a major amount of acrylate monomers such as $C_4$ to $C_8$ alkyl acrylate, preferably n-butyl acrylate, up to about 20 parts per hundred of total monomers of a monolefinically unsaturated dicarboxylic acid, most preferably itaconic acid, a small amount of crosslinking agent, preferably N-methyl acrylamide, and optionally another monolefinic monomer.

Using a modified semibatch process in which preferably the itaconic acid is fully charged initially to the reactor with the remaining monomers added over time, a latex of unique polymer architecture or morphology is created, leading to the unique rubbery properties of the cured films produced therefrom.

The third ingredient of Release Layer Formulation 1 is a water resistant aid such as a polyurethane dispersion which provides a self-crosslinking solvent and emulsifier-free aqueous dispersion of an aliphatic urethane-acrylic hybrid polymer which, alone, produces a clear, crack-free film on drying having very good scratch, abrasion and chemical resistance. This ingredient is also a softener for the acrylic dispersion and plasticizer aid.

A water resistant aid may be produced by polymerizing one or more acrylate and other ethylenic monomers in the presence of an oligourethane to prepare oligourethane acrylate copolymers. The oligourethane is preferably prepared from diols and diisocyanates, the aliphatic or alicyclic based diisocyanates being preferred, with lesser amounts, if any, of aromatic diisocyanates, to avoid components which contribute to yellowing. Polymerizable monomers, in addition to the usual acrylate and methacrylate esters of aliphatic monoalcohols and styrene, further include monomers with carboxyl groups, such as acrylic acid or methacrylic acid, and those with other hydrophilic groups such as the hydroxyalkyl acrylates (hydroxyethyl methacrylate being exemplary). The hydrophilic groups in these monomers render the copolymer product dispersible in water with the aid of a neutralizing agent for the carboxyl groups, such as dimethylethanolamine, used in amount to at least partially neutralize the carboxyl groups after dispersion in water and vacuum distillation to remove any solvents used to prepare the urethane acrylic hybrid. Further formulations may include the addition of crosslinking components such as amino resins or blocked polyisocyanates. Although pigments and fillers could be added to any of the coating layers, such use to uniformly tint or color the coated paper could be used for special effect, but would not be used where an image is desired in the absence of background coloration. Urethane acrylic hybrid polymers are further described in U.S. Pat. No. 5,708,072, and their description in this application is incorporated by reference.

Self crosslinking acrylic polyurethane hybrid compositions can also be prepared by the processes and materials of U.S. Pat. No. 5,691,425, herein incorporated by reference. These are prepared by producing polyurethane macromonomers containing acid groups and lateral vinyl groups, optionally terminal vinyl groups, and hydroxyl, urethane, thiourethane and/or urea groups. Polymerization of these macromonomers produces acrylic polyurethane hybrids which can be dispersed in water and combined with crosslinking agents for solvent-free coating compositions.

Autocrosslinkable polyurethane-vinyl polymers are discussed in detail in U.S. Pat. No. 5,623,016 and U.S. Pat. No. 5,571,861, and their disclosure of these materials is incorporated by reference. The products usually are polyurethane-acrylic hybrids, but with self-crosslinking functions. These may be carboxylic acid containing, neutralized with, e.g. tertiary amines such as ethanolamine, and form useful adhesives and coatings from aqueous dispersion.

The elastomeric emulsion and polyurethane dispersion are, generally, thermoplastic elastomers. Thermoplastic elastomeric polymers are polymer blends and alloys which have both the properties of thermoplastic polymers, such as having melt flow and flow characteristics, and elastomers, which are typically polymers which cannot melt and flow due to covalent chemical crosslinking (vulcanization). Thermoplastic elastomers are generally synthesized using two or more monomers that are incompatible; for example, styrene and butadiene. By building long runs of polybutadiene with intermittent polystyrene runs, microdomains are established which imparts the elastomeric quality to the polymer system. However, since the microdomains are established through physical crosslinking mechanisms, they can be broken by application of added energy, such as heat from a hand iron, and caused to melt and flow; and therefore, are elastomers with thermoplastic quality.

Thermoplastic elastomers have been incorporated into the present invention in order to provide the image transfer system with elastomeric quality. Two thermoplastic elastomer systems have been introduced; that is, a polyacrylate terpolymer elastomer (for example, Hystretch V-29) and an aliphatic urethane acryl hybrid (for example, Daotan VTW 1265). Thermoplastic elastomers can be chosen from a group that includes, for example, ether-ester, olefinic, polyether, polyester and styrenic thermoplastic polymer systems. Specific examples include, by way of illustration, thermoplastic elastomers such as polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly (vinyl chloride). Generally, thermoplastic elastomers can be selected from a group having a glass transition temperature (Tg) ranging from about −50° C. to about 25° C.

The fourth component of Release Layer Formulation 1 is a plasticizer such as a polyethylene glycol dispersion which provides mechanical stability, water repellency, and allows for a uniform, crack-free film. Accordingly, a reason to add the polyethylene glycol dispersion is an aid in the coating process. Further, the polyethylene glycol dispersion acts as an softening agent. A preferred fourth component is Carbowax Polyethylene Glycol 400, available from Union Carbide.

An optional fifth ingredient of Release Layer Formulation 1 is a surfactant and wetting agent such as polyethylene glycol mono ((tetramethylbutyl) phenol) ether. The surfactant and wetting agent are preferably present in an amount of from 0.5 to 5 weight %, more preferably from 1 to 3 weight %, most preferably 1% by weight.

Release Layer Formulation 1, as a preferred embodiment of the invention, is especially suitable for laser copiers and laser printers since it is wax free.

In another embodiment of the invention (Release Layer Formulation 2), the release layer comprises an acrylic binder and a wax emulsion. The release layer may further contain a retention aid such as Hercobond 2000®. The retention aid provides washfastness, or the inhibition of color fading in the wash, which enhances the washability of the image on the receptor.

Alternatively, the binders suitable for Release Layer Formulation 1 may be used in lieu of the above-described ethylene acrylic acid copolymer dispersion.

Formulation 2 works in a laser printer or copier despite the presence of wax since the wax is present in sufficiently low amounts so as to not adversely affect imaging such as, for example, by melting within the printer or copier (i.e., at most about 25 parts (weight)).

In another embodiment of the invention, the release layer of U.S. application Ser. No. 09/541,083 to Williams et al. may be used in the present invention.

In another embodiment of the invention, the above-described release layer is divided into two separate layers. An example of this embodiment is a layer comprising ethylene acrylic acid that allows release or separation. An elastomer and polyurethane of the present invention, as well as any additives discussed above, are combined in a second layer that provides the above-described transfer qualities (i.e., washability).

4. The Image Receiving Layer

The optional image receiving layer functions as a colorant receptive layer for the image. Accordingly, the image receiving layer must be modified according to the marker that is being applied. However, the image receiving layer is not required if the selected composition from which the image is formed will adhere to the release layer.

In an embodiment where the substrate is marked with a laser copier or printer, the optional image receiving layer is an acrylic coating upon which an image is applied. The image receiving layer may comprise a film-forming binder selected from the group comprising of ethylene-acrylic acid copolymers, polyolefins, and waxes. A preferred binder, especially when a laser copier or laser printer is used in accordance with this invention is an ethylene acrylic acid co-polymer dispersion (Image Receiving Layer Formulation 1).

Alternatively, the binders suitable for Release Layer Formulation 1 may be used in lieu of the above-described ethylene acrylic acid copolymer dispersion.

In a preferred embodiment of the invention, when an ink jet printer is used in accordance with the present invention, the image receiving layer may utilize the materials of the fourth layer of U.S. Pat. No. 5,798,179. Thus, for practicing the present invention using an ink jet printer, the image receiving layer may comprise particles of a thermoplastic polymer having largest dimensions of less than about 50 micrometers. Preferably, the particles will have largest dimensions of less than about 50 micrometers. More preferably, the particles will have largest dimensions of less than about 20 micrometers. In general, the thermoplastic polymer may be any thermoplastic polymer which meets the criteria set forth herein. Desirably, the powdered thermoplastic polymer will be selected from the group consisting of polyolefins, polyesters, polyamides, and ethylene-vinyl acetate copolymers.

The Image Receiving Layer also includes from about 10 to about 50 weight percent of a film-forming binder, based on the weight of the thermoplastic polymer. Desirably, the amount of binder will be from about 10 to about 30 weight percent. In general, any film-forming binder may be employed which meets the criteria set forth herein. When the Image Receiving Layer includes a cationic polymer as described below, a nonionic or cationic dispersion or solution may be employed as the binder. Suitable binders include polyacrylates, polyethylenes, and ethylene-vinyl acetate copolymers. The latter are particularly desired because of their stability in the presence of cationic polymers. The binder desirably will be heat softenable at temperatures of about 190° C. or lower (e.g. 120°).

The basis weight of the Image Receiving Layer may vary from about 1 to about 30 g/m$^2$. Desirably, the basis weight will be from about 1 to about 20 g/m$^2$. The Image Receiving Layer may be applied to the release layer by means well known to those having ordinary skill in the art, for example, as described herein below. The Image Receiving Layer typically will have a melting point of from about 65° C. to about 180° C. Moreover, the Image Receiving Layer may contain from about 2 to about 20 weight percent of a cationic polymer, based on the weight of the thermoplastic polymer. The cationic polymer may be, for example, an amide-epichlorohydrin polymer, polyacrylamides with cationic functional groups, polyethyleneimines, polydiallylamines, and the like. When a cationic polymer is present, a compatible binder should be selected, such as a nonionic or cationic dispersion or solution. As is well known in the paper coating art, many commercially available binders have anionically charged particles or polymer molecules. These materials are generally not compatible with the cationic polymer which may be used in the Image Receiving Layer.

One or more other components may be used in the Image Receiving Layer. For example, this layer may contain from about 1 to about 20 weight percent of a humectant, based on the weight of the thermoplastic polymer. Desirably, the humectant will be selected from the group consisting of ethylene glycol and poly(ethylene glycol). The poly (ethylene glycol) typically will have a weight-average molecular weight of from about 100 to about 40,000. A poly(ethylene glycol) having a weight-average molecular weight of from about 200 to about 15,000 is particularly useful.

The Image Receiving Layer also may contain from about 0.2 to about 10 weight percent of an ink viscosity modifier, based on the weight of the thermoplastic polymer. The viscosity modifier desirably will be a poly(ethylene glycol) having a weight-average molecular weight of from about 100,000 to about 2,000,000. The poly(ethylene glycol) desirably will have a weight-average molecular weight of from about 100,000 to about 600,000.

Other components which may be present in the Image Receiving Layer include from about 0.1 to about 5 weight percent of a weak acid and from about 0.5 to about 5 weight percent of a surfactant, both based on the weight of the thermoplastic polymer. A particularly useful weak acid is citric acid. The term "weak acid" is used herein to mean an acid having a dissociation constant less than one (or a negative log of the dissociation constant greater than 1).

The surfactant may be an anionic, a nonionic, or a cationic surfactant. When a cationic polymer is present in the Image Receiving Layer, the surfactant should not be an anionic surfactant. Desirably, the surfactant will be a nonionic or cationic surfactant. However, in the absence of the cationic polymer, an anionic surfactant may be used, if desired. Examples of anionic surfactants include, among others, linear and branched-chain sodium alkylbenzenesulfonates, linear and branched-chain alkyl sulfates, and linear and branched-chain alkyl ethoxy sulfates. Cationic surfactants include, by way of illustration, tallow trimethylammonium chloride. Examples of nonionic surfactants, include, again by way of illustration only, alkyl polyethoxylates, polyethoxylated alkylphenols, fatty acid ethanol amides, complex polymers of ethylene oxide, propylene oxide, and alcohols, and polysiloxane polyethers. More desirably, the surfactant will be a nonionic surfactant.

The image receiving layer can contain the addition of filler agents with the purpose of modulating the surface characteristics of the present invention. The surface roughness and coefficient of friction may need to be modulated depending on such factors as desired surface gloss and the imaging device's specific paper feeding requirements. The filler can be selected from a group of polymers such as, for example, polyacrylates, polyacrylics, polyethylene, polyethylene acrylic copolymers and polyethylene acrylate copolymers, vinyl acetate copolymers and polyvinyl polymer blends that have various particle dimensions and shapes. Typical particle sizes may range from 0.1 to 500 microns. Preferably, the particle sizes range from 5 to 100 microns. More preferably, the particle sizes range from 5 to 30 microns. The filler may also be selected from a group of polymers such as, for example, cellulose, hydroxycellulose, starch and dextran. Silicas and mica may also be selected as a filler. The filler is homogeneously dispersed in the image layer in concentrations ranging from 0.1 to 50%. Preferably, the filler concentration range is 1 to 10 percent.

In additional embodiments, the image layer of Provisional Application No. 60/127,625 (now U.S. application Ser. No. 09/541,083) may be used as the image receiving layer of the present invention.

The various layers of the transfer material are formed by known coating techniques, such as by curtain coating, Meyer rod, roll, blade, air knife, cascade and gravure coating procedures.

The layers of the present invention may be prepared, coated and transferred as shown in Provisional Application No. 60/127,625 (now U.S. application Ser. No. 09/541,083).

The first layer to be coated on the substrate is the barrier layer. The barrier layer followed by the release layer, and then the optional image receiving layer.

In referring to FIG. 1, there is generally illustrated a cross-sectional view of the transfer sheet 20 of the present invention. The substrate 21 comprises a top and bottom surface. The thermosetting and/or UV curable barrier layer 22 is coated onto the top surface of the substrate 21. The release layer 23 is then coated onto the barrier layer 22. Finally, the image receiving layer 24 is coated on top of the release layer 23. Each component in the substrate coating plays a role in the transfer process. The thermosetting or UV curable barrier layer solution prevents the release layer from permanently adhering to the paper stock if paper is used as a support. Within the release layer solution, the acrylic polymer provides the release properties to effectively transfer the printed image from the substrate to the receptor. The acrylic polymer within the image receiving layer provides a uniform surface upon which, for instance, the toner is applied.

After the image receiving layer has completely dried, an antistatic agent discussed above may be applied to the non-coated side of the transfer sheet as an antistatic layer 25. The coating will help eliminate copier or printer jamming by preventing the electrostatic adhesion of the paper base to the copier drum of electrostatic copiers and printers.

B. Receptor

The receptor or receiving element receives the transferred image. A suitable receptor includes but is not limited to textiles including cotton fabric, and cotton blend fabric. The receptor element may also include glass, metal, wool, plastic, ceramic or any other suitable receptor. Preferably the receptor element is a tee shirt or the like.

The image, as defined in the present application may be applied in any desired manner, such as from a color or monochrome laser printer or a color or monochrome laser copier.

To transfer the image, the imaged transfer element is placed image side against a receptor. A transfer device (i.e., a hand iron or heat press) is used to apply heat to the substrate which in turn releases the image. The temperature transfer range of the hand iron is generally in the range of 110 to 220° C. with about 190° C. being the preferred temperature. The heat press operates at a temperature transfer range of 100 to 220° C. with about 190° C. being the preferred temperature. The transfer device (e.g., a household iron or a heat press) is placed over the non-image side of the substrate and moved in a circular motion (hand iron only). Pressure (i.e., typical pressure applied during ironing) must be applied as the heating device is moved over the substrate (see FIG. 1). After about two minutes to five minutes (with about three minutes being preferred) using a hand iron and 10 seconds to 50 seconds using a heat press (with about twenty seconds being preferred) of heat and pressure, the transfer device is removed from the substrate. The transfer element is optionally allowed to cool from one to five minutes. The substrate is then peeled away from the image which is adhered to the receptor.

Additional embodiments of the present invention include substituting the transfer material of the present invention as the support and transfer layer in U.S. Provisional Application No. 60/056,446 (now abandoned U.S. patent application Ser. No. 09/138,553), wherein the transfer material of the present invention is used in conjunction with a silver halide emulsion layer. Further, silver halide grains may be dispersed in the release layer of the present invention in the same manner as described in U.S. Pat. No. 6,033,824 issued Mar. 7, 2000.

The transfer material of the present invention may be used in place of the support and transfer layer of U.S. patent application Ser. No. 09/191,373, wherein the transfer material of the present invention is used in conjunction with CYCOLOR technology. The transfer material of the present invention may additionally be used as the transfer layer of U.S. patent application Ser. No. 09/191,369, wherein the release layer of the present invention is used in conjunction with thermo-autochrome technology. Further, the microcapsules may be dispersed within the release layer of the present invention in lieu of a separate transfer layer as in U.S. patent application Ser. No. 08/970,424.

An additional embodiment of the present invention is a coated transfer sheet comprising, as the Release Layer, the third layer of U.S. Pat. No. 5,798,179 to Kronzer (U.S. '179) may be used. That is, the Release Layer may comprise a thermoplastic polymer which melts in a range of from about 65° C. to about 180° C. and has a solubility parameter more than about 19 $(Mpa)^{1/2}$.

The third layer in U.S. '179 functions as a transfer coating to improve the adhesion of subsequent layers in order to prevent premature delamination of the heat transfer material. The layer may be formed by applying a coating of a film-forming binder over the second layer. The binder may include a powdered thermoplastic polymer, in which case the third layer will include from about 15 to about 80 percent by weight of a film-forming binder and from about 85 to about 20 percent by weight of the powdered thermoplastic polymer. In general, each of the film-forming binder and the powdered thermoplastic polymer will melt in a range from about 65° C. to about 180° C. For example, each of the film-forming binder and powdered thermoplastic polymer may melt in a range from about 80° C. to about 120° C. In addition, the powdered thermoplastic polymer will comprise particles which are from about 2 to about 50 micrometers in diameter.

The following examples are provided for a further understanding of the invention, however, the invention is not to be construed as limited thereto.

EXAMPLE 1

An example of the barrier layer of the present invention is Barrier Layer Formulation 1:

| Compound | Chemical Class | General (parts by mass) | Preferably (parts by mass) | Most Preferably (parts by mass) |
|---|---|---|---|---|
| Uvacure 1500[a] | Cycloaliphatic epoxide | 10.0–60.0 | 20.0–50.0 | 30.0–40.0 |
| Uvacure 1562[b] | Cycloaliphatic epoxy resin | 40.0–0.0 | 30.0–10.0 | 25.0–15.0 |
| DEN 431[c] | epoxy novolac resin | 5.0–30.0 | 10.0–20.0 | 12.0–18.0 |
| 2-propanol | Alcohol | 44.4–0.0 | 38.3–12.4 | 30.8–21.7 |
| Uvacure 1590[a] | activated epoxy | 0.5–7.0 | 1.5–6.0 | 2.0–4.0 |
| Ebecryl BPO[a] | aryl ketone | 0.1–1.0 | 0.2–0.6 | 0.2–0.5 |
| BYK 354[c] | Polyacrylate | 0.0–1.0 | 0.0–0.5 | 0.0–0.4 |
| BYK 088[c] | Polysiloxane | 0.0–1.0 | 0.0–0.5 | 0.0–0.4 |

[a]UCB Chemical Corporation - Radcure Busioness Unit
[b]Dow Chemicals
[c]BYK Chemie

EXAMPLE 2

Barrier Layer Formulation 1 is prepared as follows: DEN 431, an extremely viscous material, is placed into a beaker first, followed by 2-propanol. The remaining compounds are added in the order in which they appear listed in the table of Example 1. Manual agitation may be required especially because of the extreme viscosity of DEN 431. Once mechanical agitation is used, the mixture is stirred for about 30–60 minutes at a rate just below the point where cavitation would have occurred.

EXAMPLE 3

A Barrier layer comprising Barrier Layer Formulation 1 is cured as follows: a thin film of barrier layer formulation 1, in the range of 1.0 g/m$^2$ to 20 g/m$^2$, is applied to a substrate and cured at <50 mJ/cm$^2$ with a mercury vapor ultraviolet lamp.

EXAMPLE 4

Example 3 is repeated, and after UV curing, the film is further cured at temperatures between 60° C. and 200° in a heat chamber for 1 to 45 minutes.

EXAMPLE 5

An example of the Release Layer of the present invention is Release Layer Formulation 1:

Release Layer Formulation 1

| Components | Parts by weight |
|---|---|
| Ethylene Acrylic Acid Co-polymer Dispersion (Michem Prime 4983R, Michelman) | 86 parts |
| Elastomeric emulsion (Hystretch V-29, BFGoodrich) | 5 parts |
| Polyurethane Dispersion (Daotan VTW 1265, Vianova Resins) | 4 parts |
| Polyethylene Glycol (Carbowax Polyethylene Glycol 400, Union Carbide) | 4 parts |
| Polyethylene Glycol Mono ((Tetramethylbutyl) Phenol) Ether (Triton X-100, Union Carbide) | 1 part |

Release Layer Formulation 1 may be prepared as follows: five parts of the elastomer dispersion are combined with eighty-six parts of an ethylene acrylic acid co-polymers dispersion by gentle stirring to avoid cavitation. Four parts of a polyurethane dispersion are then added to the mixture. Immediately following the addition of a polyurethane dispersion, four parts of a polyethylene glycol and one part of an nonionic surfactant (e.g., Triton X-100) are added. The entire mixture is allowed to stir for approximately fifteen minutes at a moderate stir rate (up to but not exceeding a rate where cavitation occurs). Once thoroughly combined, the mixture is filtered (for example, through a 53 $\mu$m nylon mesh).

EXAMPLE 6

A second embodiment of the Release Layer is the following formulation:

Release layer Formulation 2

| Components | Parts |
|---|---|
| Ethylene Acrylic Acid Co-polymers dispersion (Michem Prime 4938R, Michelman) | 74 parts (weight) |
| Wax Dispersion (Michelman 73635M, Michelman) | 25 parts (weight) |
| Retention Aid (Hercobond 2000, Hercules) | 1 part (weight) |

Formulation 2 may be prepared in the following manner: the ethylene acrylic acid co-polymer dispersion and the wax dispersion are stirred (for example in a beaker with a stirring bar). The retention aid is added, and the stirring continues until the retention aid is completely dispersed.

EXAMPLE 7

The following is a preferred Image Receiving Layer formulation:

Image Receiving Layer Formulation 1

| Components | Parts |
|---|---|
| Ethylene Acrylic Acid Co-polymers Dispersion (Michem Prime 4983R, Michelman). | 100 parts |

EXAMPLE 8

Below is a preferred image receiving layer formulation that further contains a filler agent:

Image Receiving Layer Formulation 2

| Compound | Parts |
|---|---|
| Ethylene Acrylic Copolymer Dispersion (Michem 4983R, Michelman) | 90 to 99 |
| Ethylene Vinyl Acetate Copolymer Powder (Microthene FE-532-00, Equistar Chemical) | 10 to 1 |

EXAMPLE 9

Below is a second preferred image receiving layer formulation that further contains a filler agent:

| Image Receiving Layer Formulation 3 | |
|---|---|
| Compound | Parts |
| Ethylene Acrylic Copolymer Dispersion (Michem 4983R, Michelman) | 90 to 99 |
| Oxidized polyethylene homopolymer (Acumist A-12, Allied Signal Chemical) | 10 to 1 |

EXAMPLE 10

By way of illustration, the image receiving layer may comprise the following formulation compositions:

| Formulation | Description |
|---|---|
| A | 100 parts Orgasol 3501 EXDNAT 1 (a 10-micrometer average particle size, porous, copolymer of nylon 6 and nylon 12 precursors), 25 parts Michem Prime 4983R, 5 parts Triton X100 and 1 part Methocel A-15 (methyl cellulose). The coating weight is 3.5 lb. per 1300 square feet. |
| B | Like A, but with 5 parts of Tamol 731 per 100 parts Orgasol 3501, and the Metholcel A-15 is omitted. |
| C | Like a Reichold 97-635 release coat (a modified poly(vinyl acetate)), but containing 50 parts of Tone 0201 (a low molecular weight polycaprolactone) per 100 parts Orgasol 3501. |
| D | 100 parts Orgasol 3501, 5 parts Tamol 731, 25 parts Michel Prime 4983R and 20 parts PEG 20M. |
| E | 100 parts Orgasol 3501, 5 parts Tamol 731, 25 parts Michel Prime 4983R and 5 parts PEG 20M (a polyethylene glycol having a molecular weight of 20,000). |
| F | 100 parts Orgasol 3501, 5 parts Tamol 731, 25 parts Michem Prime 4983R and 20 parts PEG 20M (an ethylene glycol oligomer having a molecular weight of 200) |
| G | 100 parts Orgasol 3501, 5 parts Tamol 731 and 25 parts Sancor 12676 (Sancor 12676 is a heat sealable polyurethane). |

EXAMPLE 11

A transfer sheet of the present invention is prepared as follows:

A barrier layer comprising Barrier Layer Formulation 1 is coated onto a copier paper substrate. The barrier layer polymer dispersion is coated by, for example, applying the dispersion in a long line across the top edge of the paper. Using a #10 metering rod, the bead of solution is spread evenly across the paper. The coated paper is cured as previously described. Coating can also be achieved by standard methods such as curtain, air knife, cascade, etc.

Once the barrier layer has completely cured, the release layer solution is coated directly on top of the barrier layer. For this Example, the release layer is Release Layer Formulation 1. The release layer solution is applied in a long line across the top edge of the paper and barrier layer. Using a #30 metering rod, the bead of solution is spread evenly across the substrate. This drawdown procedure is twice repeated. The coated paper is force air dried for approximately two minutes.

Once the release layer has completely dried, the (optional) image receiving layer solution is coated directly on top of the release layer. For the purposes of this Example, the image receiving layer is Image Receiving Layer 1. Accordingly, the image receiving layer comprises ethylene acrylic acid. The image receiving layer solution is applied in a long line across the top edge of the release layer. Using a #4 metering rod, the bead of solution is spread evenly across the substrate. The coated substrate is force air dried for approximately one minute.

Once the substrate is dry, it is placed into a laser printer or copier and imaged upon. The following table can be used as a guide to determine optimum coating weights and thickness of the Barrier, Release and Image Layers:

| Coat Weights and Thickness | | | |
|---|---|---|---|
| | Wet Coat ($g/m^2$) | Dry Coat ($g/m^2$) | Thickness (mil) |
| Barrier Layer | 28 | 1 to 20 | 0.04 to 0.80 |
| Release Layer | 96.2 | 12 to 50 | 0.48 to 2.00 |
| Image Layer | 20 | 2 to 25 | 0.05 to 1.0 |

EXAMPLE 12

Figure 2:
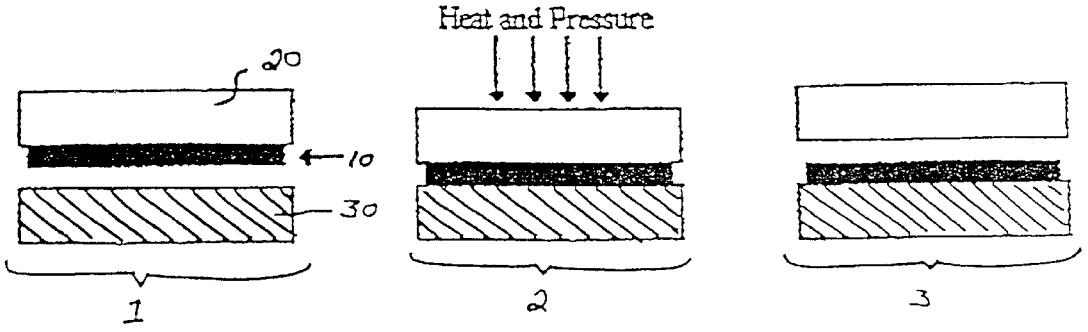
FIG. 2 illustrates the image transfer procedure.

This Example demonstrates the image transfer procedure. Referring to FIG. 2, to transfer the image, (1) the substrate 20 is placed image side against a receptor 30 of the present invention. In this example, receptor 30 is a tee shirt. A transfer device of the present invention (i.e., a hand iron or heat press) is used to apply heat to the substrate 20, which in turn releases the image 10. The temperature transfer range of the hand iron is about 190° C. The heat press operates at a temperature transfer range of about 190° C. (2) The transfer device is placed over the non-image side of the substrate 20 and moved in a circular motion (if the hand iron is used). Usual pressure applied when ironing is applied as the heating device is moved over the substrate 20. After about 180 seconds (15 seconds if using the heat press) of heat and pressure, the transfer device is removed from the substrate 20. The substrate 20 is allowed to cool for about five minutes. (3) The substrate 20 is then peeled away from the receptor.

EXAMPLE 13

Figure 3:
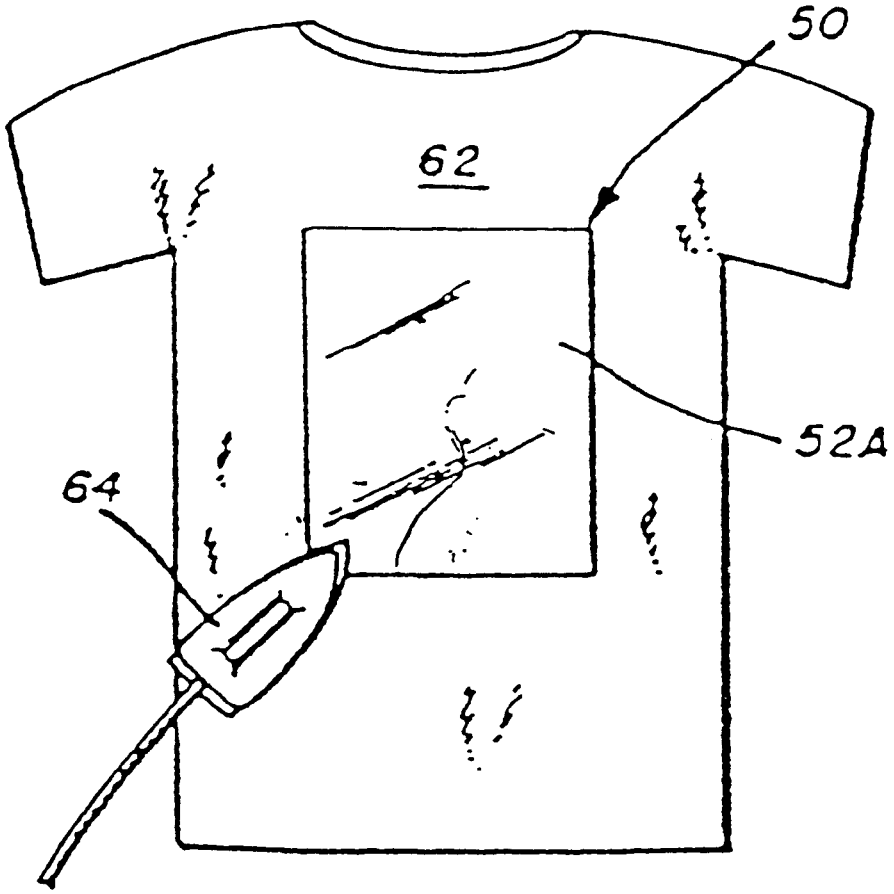

Referring to FIG. 3, the method of applying an image to a receptor element will be described. More specifically, FIG. 3 illustrates how the step of heat transfer from the transfer sheet 50 to a tee shirt or fabric 62 is performed.

The transfer sheet is prepared, and imaged upon as described herein. A tee shirt 62 is laid flat, as illustrated, on an appropriate support surface, and the imaged surface of the transfer sheet 50 is positioned onto the tee shirt. An iron 64 set at its highest heat setting is run and pressed across the back 52A of the transfer sheet. The image and nonimage areas are transferred to the tee shirt and the transfer sheet is removed and discarded.

EXAMPLE 14

A transfer sheet of the present invention is compared with a transfer material of U.S. Pat. No. 5,798,179 to Kronzer. Both formulations comprise a substrate coated with a Barrier Layer and overcoated with a heat-activated Release Layer. The substrate is imaged upon and transferred to a receptor with the application of heat and pressure.

The transfer sheet of the present invention comprises a barrier layer using Barrier Layer Formulation 1, and the transfer sheet of U.S. '179 is prepared using a barrier layer solution of Synthemul 97635-00, a polyvinyl acetate, available from Reichhold Chemicals, Inc., Research Triangle Park, N.C.

The release layer solution of the present invention for this Example comprises Michelman Michem Prime 4983R (86 Parts), BF Goodrich Hystretch V-29 (5 parts), Union Carbide Carbowax PG 400 (4 parts), Vianova Daotan VTW 1265 (4 parts) and Triton X-100 (1 part) with a 3.0 mil (wet) coat thickness.

The release layer solution for the transfer material of U.S. Pat. No. 5,798,179 to Kronzer is 100 parts Michelman Michem Prime 4983R with a 3.0 mil (wet) coat thickness.

Two sheets of standard ink jet printer paper are coated (3.0 mil (wet) coat thickness) with the above Barrier Layer solution and forced air dried for one minute. After drying, one sheet is coated with the above-described U.S. '179 release layer solution (3.0 mil (wet) coat thickness) and the other sheet is coated with the above-described present invention release layer solution. The sheets are again force air dried for one minute.

The dried sheets are imaged upon using a color laser printer. The obtained images are transferred onto a 100% cotton receptor in accordance with Example 12 using a hand iron at 190° C. for 3 minutes. The images are allowed to cool for 2 minutes. Once cool, the transfer sheets are peeled away from the receptor (i.e., a cotton tee shirt). The receptor is washed five times on normal cycle with Tide® brand detergent (cold wash, cold rinse). The receptor is dried after each wash cycle on low heat for 30 minutes.

The image transferred in accordance with the present invention is unexpectedly superior in color saturation, image detail, image cracking, and fabric adherence. The present invention is also unexpectedly superior with respect to resistance to damage during repeated machine washings.

EXAMPLE 15

A transfer sheet of the present invention is coated with a silver halide emulsion.

Silver halide grains as described in Example 1 of U.S. patent application Ser. No. 09/138,553 are prepared by mixing a solution of 0.3 M silver nitrate with a solution of 0.4 M sodium chloride.

Thus, in this example, the silver halide grains are coated on top of the present transfer material in the same manner as in conventional photographic systems.

The sensitized paper is exposed and processed in the same manner as described in U.S. patent application Ser. No. 09/138,553. That is, the sensitized paper is exposed to room light for about 30 seconds and then developed in color treatment chemistry known in the art as RA-4 (Eastman Kodak). The working solution RA-4 is a paper development color process. The coupler magenta, cyan or yellow color coupling dye is added to the RA-4 working solution before development. Therefore, it is similar to the color development process known as the K-14 Kodachrome process (Eastman Kodak). The test sample is a sample of what a magenta layer (red-blue hue) would look like if separated. The resulting uniform image contains both the silver and color coupler dyes. Both the material and dye image can withstand bleaching to remove silver, thereby leaving only the color image. The material is then dried.

The resulting photographic image is transferred as in Example 12, above.

EXAMPLE 16

Example 15 is repeated, except that the silver halide grains are dispersed in the Release Layer of the present invention in the same manner as described in U.S. Pat. No. 6,033,824 issued Mar. 7, 2000, where the silver halide grains are dispersed in the transfer layer.

EXAMPLE 17

A layer of photosensitive microcapsules as described in U.S. Pat. No. 4,904,645 is coated onto the transfer material of the present invention in the manner described in Example 1 of U.S. patent application Ser. No. 09/191,373. Then, the coated sheet is then image-wise exposed through a mask for 5.2 seconds using a fluorescent light source. The exposed transfer sheet is processed at high temperatures with a calendaring roll as described in Example 1 of U.S. Pat. No. 4,751,165. After exposure the transfer sheet is then applied to a receptor in the manner described in Example 12, above.

EXAMPLE 18

Example 17 is repeated, except the microcapsules are dispersed in the Release Layer of the present invention in the same manner as the microcapsules are dispersed in the transfer layer as shown in Example 1 of U.S. patent application Ser. No. 08/970,424. That is, photosensitive microcapsules are prepared in the manner described in U.S. Pat. No. 4,904,645 and are dispersed in the Release Layer of the present invention. The transfer sheet is then prepared in the manner described in Example 11 of the present invention. Then, the coated sheet is then image-wise exposed through a mask for 5.2 seconds using a fluorescent light source. The exposed sheet is processed at high temperatures with a calendaring roll as described in Example 1 of U.S. Pat. No. 4,751,165. After exposure the transfer sheet is then applied to a receptor in the manner described in Example 12, above.

EXAMPLE 19

The light-fixable thermal recording layer according to Example 2 of U.S. Pat. No. 4,771,032 is coated onto the transfer material of the present invention in the same manner as in Example 1 of U.S. patent application Ser. No. 60/065,894, where a light-fixable thermal recording layer according to Example 2 of U.S. Pat. No. 4,771,032 is coated onto the transfer layer. The obtained recording material is then subjected to the procedure described in U.S. Pat. No. 5,486,446 as follows.

Applied power to thermal head and pulse duration are set so that the recording energy per area is 35 $mJ/mm^2$. The writing of the heat-sensitive recording material is conducted using a thermal head (KST type, a product of Kyocera K.K.).

Subsequently, the recording material is exposed to an ultraviolet lamp (light emitting central wavelength: 420 nm; output 40W for 10 seconds. Applied power to the thermal head and pulse duration are again set so that the recording energy per unit area is 62 $mJ/mm^2$, and writing of the heat-sensitive recording material is conducted under these applied energies.

Furthermore, the recording material is exposed to an ultraviolet lamp (light emitting central wavelength: 365 nm; output: 40W) for 15 seconds. Applied power to the thermal head and pulse duration are again set so that the recording energy per unit is 86 $mJ/mm^2$, and writing of the heat-sensitive recording material is conducted under these conditions. The coated transfer sheet is prepared, exposed, and developed according to U.S. patent application Ser. No. 09/191,369.

EXAMPLE 20

Example 19 is repeated, except that the microcapsule-containing direct thermal recording imaging element is dispersed in the release layer in the same manner as the microcapsules are dispersed in the transfer material as shown in U.S. patent application Ser. No. 08/970,424. That is, the microcapsules are blended together with Release Layer Formulation 1 of the present invention. The transfer sheet is then exposed as demonstrated in Example 19, above. The exposed transfer sheet is then transferred as demonstrated in Example 12, above.

EXAMPLE 21

Example 11 is repeated, except that once the image layer has completely dried, the following antistatic layer is coated on the backside of the substrate (the previously non-coated side).

| Antistatic Layer Solution Formulation 1 | |
|---|---|
| Water | 90 parts |
| Quaternary ammonium salt solution (Statik-Blok J-2, Amstat Industries) | 10 parts |

The antistatic solution is applied in a long line across the top edge of the substrate using a #4 metering rod. The coated substrate is force air dried for approximately one minute.

The antistatic solution of this Example has the following characteristics: the solution viscosity as measured on a Brookfield DV-I+ viscometer, LV1 spindle @60 RPM is 2.0 (cP) at 24.5° C. The coating weights (wet) are 10 to 20 g/m$^2$. The surface tension is 69.5 dynes/cm at 24° C.

Once the substrate and antistatic coating are dry, the coated transfer sheet is placed into an electrostatic printer and imaged upon.

EXAMPLE 22

Example 21 is repeated, except that the following formulation is used as the antistatic layer and is coated on the backside of the substrate (the previously non-coated side):

| Antistatic Layer Solution Formulation 2 | |
|---|---|
| Water | 90 parts |
| Polyether (Marklear ALF-23, Witco Ind.) | 5 parts. |

EXAMPLE 23

A transfer sheet of the present invention is prepared as follows:

Barrier Layer Formulation 1 is coated onto a substrate of the present invention as shown in Example 11.

Once the barrier layer has completely cured, the release layer solution is coated directly on top of the barrier layer. For this Example, the release layer is the third layer of U.S. Pat. No. 5,798,179 to Kronzer. The release layer solution is applied in a long line across the top edge of the paper and barrier layer. Using a #30 metering rod, the bead of solution is spread evenly across the substrate. The coated paper is force air dried for approximately two minutes.

Once the release layer has completely dried, the (optional) image receiving layer solution is coated directly on top of the release layer. For the purposes of this Example, the image receiving layer is Image Receiving Layer 1. Accordingly, the image receiving layer comprises ethylene acrylic acid. The image receiving layer solution is applied in a long line across the top edge of the release layer. Using a #30 metering rod, the bead of solution is spread evenly across the substrate. The coated substrate is force air dried for approximately two minutes. Once the substrate is dry, it is placed into a laser printer or copier and imaged upon.

EXAMPLE 24

This Example demonstrates different solution viscosities, wet coating weights, and surface tension for preferred formulations Release Layer Formulation 1, Barrier Layer Formulation 1, and Image Layer Formulation 1.

| Solution Viscosities* | | |
|---|---|---|
| Solution | Viscosity (cP) | Temperature (° C.) |
| Barrier Layer | 100 | 27.8 |
| Release Layer | 125 | 28.9 |
| Image Layer | 150 | 27.8 |
| Antistatic Layer | 2.0 | 24.5 |
| **Coating weights (wet)** | | |
| Solution | g/ft$^2$ | g/m$^2$ |
| Barrier Layer | 2.53 | 27.22 |
| Release Layer | 9.41 | 101.23 |
| Image Layer | 1.58 | 17.00 |
| Antistatic Layer | 1.67 | 18.00 |
| **Surface Tension of Each Solution** | | |
| | Surface Tension (dynes/cm) | Temperature (° C.) |
| Barrier Layer Solution | 43.5 | 24 |
| Release Layer Solution | 46.2 | 24 |
| Image Layer Solution | 50.5 | 24 |
| Antistatic Layer Solution | 69.5 | 24 |

*Viscosities measured on a Brookfield DV-I + viscometer, LV2 spindle @ 60 RPM

EXAMPLE 25

Suitable formulations using PET (EvCote PWR-25) for use in barrier layers are shown below. Variations -within the upper and lower limits illustrated by Mixtures A and F should be understood as being within the scope of the invention, although they are not explicitly set forth below.

| Barrier layer formulations using PET | | |
|---|---|---|
| Mixture | PET (parts) | Water (parts) |
| A | 100 | 0 |
| B | 90 | 10 |
| C | 75 | 25 |
| D | 67 | 33 |
| E | 50 | 50 |
| F | 33 | 67 |

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A coated transfer sheet comprising:

a substrate having a first and second surface;

at least one barrier layer consisting essentially of a polymer selected from the group consisting of a thermosetting polymer, an ultraviolet curable polymer, and combinations thereof; and at least one release layer comprising a film forming binder overlaying said at least one barrier layer, said release layer is capable of:

separating from the barrier layer, providing adhesion of the release layer to a receptor without a separate surface adhesive layer, and providing a colorfast image when transferred to a receptor, wherein said transfer sheet does not contain an image between said substrate and said release layer.

2. The coated transfer sheet of claim 1, wherein said release layer comprises a film-forming binder, an elastomeric emulsion, a water repellant and a plasticizer.

3. The coated transfer sheet of claim 2, wherein said film-forming binder is an acrylic dispersion, said water repellant is polyurethane dispersion and said plasticizer is a polyethylene glycol.

4. The coated transfer sheet of claim 3, wherein said acrylic dispersion is an ethylene acrylic acid dispersion.

5. The coated transfer sheet of claim 3, wherein said film-forming binder melts in the range of from about 65° C. to about 180° C.;

said elastomeric emulsion has a Tg in the range of from −50° C. to 25° C.;

and said polyurethane dispersion has a Tg in the range of from −50° C. to 25° C.

6. The coated transfer sheet of claim 1, which further comprises polyethylene glycol.

7. The coated transfer sheet of claim 5, wherein said film-forming binder is present in an amount of from about 46 to about 90 percent by weight;

said elastomeric emulsion is present in an amount of from 1 to about 45 percent by weight;

said polyurethane dispersion is present in an amount of from 1 to about 8 percent;

and said release layer further comprises polyethylene glycol present in an amount of from 1 to about 8 percent by weight.

8. The coated transfer sheet of claim 1, which further comprises at least one image receiving layer overlaying said at least one release layer, said image receiving layer comprising an ethylene acrylic acid co-polymer dispersion.

9. The coated transfer sheet of claim 7, wherein said film-forming binder is present in an amount of at least about 86 percent by weight;

said elastomeric emulsion is present in an amount of at least about 5 percent by weight;

said polyurethane dispersion is present in an amount of at least about 5 percent;

and said polyethylene glycol is present in an amount of at least about 4 percent by weight.

10. The coated transfer sheet of claim 6, wherein said polyethylene glycol comprises a polyethylene glycol mono ((tetramethyl butyl) phenol) ester compound.

11. The coated transfer sheet of claim 2, wherein said elastomeric emulsion is selected from the group consisting of polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly (vinyl chloride).

12. The coated transfer sheet of claim 1, wherein said thermosetting polymer is selected from the group consisting of thermosetting acrylic polymers and blends; thermosetting polyurethanes, block polyurethanes and aromatic-functional urethanes; thermosetting polyester polymers and co-polymer systems; aromatic-functional vinyl polymers and polymer blends; and thermosetting epoxy resins.

13. The coated transfer sheet of claim 12, wherein said thermosetting acrylic polymers and blends are hydroxyl-functional acrylic polymers, carboxy-functional acrylic polymers and vinyl acrylic polymer blends.

14. The coated transfer sheet of claim 12, wherein said thermosetting polyester polymers and co-polymer systems are neopentyl glycol isophthalic polyester resins, dibromo-neopentyl glycol polyester resins and vinyl ester resins.

15. The coated transfer sheet of claim 12, wherein said thermosetting epoxy resins are epoxy novolac resins.

16. The coated transfer sheet of claim 1, wherein said ultraviolet curable polymers are selected from the group consisting of cationic mechanism setting UV curable polymers, free radical mechanism setting UV curable polymers and a hybrid resin system comprising both cationic mechanism and free radical mechanism setting UV curable polymers.

17. The coated transfer sheet of claim 1, wherein said thermosetting or ultraviolet curable polymer is combined with at least one vinyl acetate polymer.

18. The coated transfer sheet of claim 1, wherein said ultraviolet curable polymer comprises monomer and oligomer primary resins.

19. The coated transfer sheet of claim 18, wherein said monomer primary resins comprise monofunctional monomers, difunctional monomers, trifunctional monomers, higher functionality monomers, water dispersible monomers, adhesion promoting monomers, pigment dispersing monomers and scorch retarding monomers.

20. The coated transfer sheet of claim 19, wherein said monofunctional monomers are selected from the group consisting of acrylates, methacrylates, and ethylacrylates;

said difunctional monomers are selected from the group consisting of diacrylates and dimethacrylates;

said trifunctional monomers are selected from the group consisting of triacrylates and trimethacrylates;

said higher functionality monomers are selected from the group consisting of tetra- and pentaacrylates and pentaacrylate esters, aliphatic and aromatic acrylates; aromatic urethane acrylates and metallic acrylates;

said water dispersible monomers are selected from the group consisting of 2(2-ethoxyethoxy) ethylacrylate and polyethylene glycol diacrylates, and said adhesion promoting monomers are selected from the group consisting of acrylate esters and methacrylate esters.

21. The coated transfer sheet of claim 20, wherein said diacrylates and dimethacrylates are selected from the group consisting of tripropylene glycol diacrylate, bisphenol A diacrylates and ethoxylated bisphenol A dimethacrylates, and said triacrylates and trimethacrylates are selected from the group consisting of trimethylolpropane ethoxy triacrylate and trimethyl propane triacrylates.

22. The coated transfer sheet of claim 18, wherein said oligomer polymer resins are selected from the group consisting of aliphatic urethane acrylates; aliphatic urethane diacrylates; aliphatic urethane triacrylates; hexafunctional aliphatic urethane acrylates; hexafunctional aromatic urethane acrylates; trifunctional aromatic urethane acrylates, aromatic urethane acrylates; urethane methacrylates; epoxy acrylates; epoxy methacrylates; polybutadiene dimethylacrylates; diacrylates of bisphenol-A epoxy resins; modified bisphenol-A epoxy acrylate resins; novolac epoxy acrylates; modified epoxy acrylates; partially acrylated bisphenol-A epoxy resins; bisphenol-A epoxy diacrylates; polyester resins; cycloaliphatic epoxide resins; modified cycloaliphatic epoxides; aliphatic polyols; partially acrylated bisphenol-A epoxy resins; and cycloaliphatic diepoxides.

23. The coated transfer sheet of claim 22, wherein said polyester resins are selected from the group consisting of chlorinated polyester resins, modified polyester resins, polyester methacrylates, acrylated polyesters, modified polyester acrylates, modified polyester hexaacrylates, polyester tetracrylates, and hexafunctional polyester acrylates;

said cycloaliphatic epoxide resins is 3,4-epoxycyclohexyl-methyl-3,4,-epoxycyclohexane carboxylate; and said modified cycloaliphatic epoxides are selected from the group consisting of acrylate modified cycloaliphatic epoxides containing both acrylate and epoxy functionalities.

24. The coated transfer sheet of claim 1, wherein said barrier layer comprises an acrylic polymer.

25. The coated transfer sheet of claim 1, wherein said barrier layer comprises a styrene-butadiene resin.

26. The coated transfer sheet of claim 1, wherein said barrier layer comprises a polymer selected from the group consisting of: poly(dienes), poly(methacrylics), poly (acrylamides), poly(methacrylic acids), poly(vinyl ethers), poly(vinyl halides), poly(vinyl esters) and hydrolyzed or partially hydrolyzed versions thereof, poly(styrenes), poly (oxides), poly(carbonates), poly(esters), poly(anhydrides), poly(urethanes), poly(siloxanes), poly(sulfones), poly (sulfonamides), poly(amides) poly(imines), poly (benzimidazoles), and carbohydrates, and copolymers derived from any of the foregoing.

27. The coated transfer sheet of claim 1, wherein said barrier layer comprises a cycloaliphatic epoxide, optional cycloaliphatic epoxide resin, epoxy novolac resin, optional alcohol, activated epoxy, aryl ketone, optional polyacrylate, and optional polysiloxane.

28. The coated transfer sheet of claim 1, wherein said barrier layer is present in a dry coat amount of from 1 to 20 $g/m^2$.

29. The coated transfer sheet of claim 1, wherein said release layer is present in an amount of from 12 to 50 $g/m^2$.

30. The coated transfer sheet of claim 8, wherein said image receiving layer is present in an amount of from 1 to 20 $g/m^2$.

31. The coated transfer sheet of claim 1, which further comprises an antistatic layer coated on said second surface of the substrate, wherein said antistatic layer comprises a quaternary ammonium salt solution.

32. The coated transfer sheet of claim 1, which further comprises an antistatic layer coated on said second surface of the substrate, wherein said antistatic layer comprises a polyether solution.

33. A coated transfer sheet of claim 1, wherein said release layer comprises:

a film-forming binder which melts in the range of from about 65° C. to about 180° C.;

a wax dispersion; and a retention aid.

34. The coated transfer sheet of claim 33, wherein said film-forming binder is selected from the group consisting of ethylene-acrylic acid copolymers, polyolefins, and waxes.

35. The coated transfer sheet of claim 33, wherein said wax dispersion is selected from the group consisting of natural and synthetic waxes.

36. The coated transfer sheet of claim 33, wherein said retention aid is selected from the group consisting of polyvinyl alcohols, polymer latexes and silicates.

37. The coated transfer sheet of claim 33, which further comprises at least one image receiving layer overlaying said at least one release layer, wherein said image receiving layer comprises ethylene-acrylic acid copolymers.

38. The coated transfer sheet of claim 33, wherein said thermosetting polymer is selected from the group consisting of thermosetting acrylic polymers and blends; thermosetting polyurethanes, block polyurethanes and aromatic-functional urethanes; thermosetting polyester polymers and co-polymer systems; aromatic-functional vinyl polymers and polymer blends; and thermosetting epoxy resins.

39. The coated transfer sheet of claim 38, wherein said thermosetting acrylic polymers and blends are hydroxyl-functional acrylic polymers, carboxy-functional acrylic polymers and vinyl acrylic polymer blends.

40. The coated transfer sheet of claim 38, wherein said thermosetting polyester polymers and co-polymer systems are neopentyl glycol isophthalic polyester resins, dibromo-neopentyl glycol polyester resins and vinyl ester resins.

41. The coated transfer sheet of claim 38, wherein said thermosetting epoxy resins are epoxy novolac resins.

42. The coated transfer sheet of claim 33, wherein said ultraviolet curable polymers are selected from the group consisting of cationic mechanism setting UV curable polymers, free radical mechanism setting UV curable polymers and a hybrid resin system comprising both cationic mechanism and free radical mechanism setting UV curable polymers.

43. The coated transfer sheet of claim 33, wherein said thermosetting or ultraviolet curable polymer is combined with at least one vinyl acetate polymer.

44. The coated transfer sheet of claim 33, wherein said ultraviolet curable polymer comprises monomer and oligomer primary resins.

45. The coated transfer sheet of claim 44, wherein said monomer primary resins comprise monofunctional monomers, difunctional monomers, trifunctional monomers, higher functionality monomers, water dispersible monomers, adhesion promoting monomers, pigment dispersing monomers and scorch retarding monomers.

46. The coated transfer sheet of claim 45, wherein said monofunctional monomers are selected from the group consisting of acrylates, methacrylates, and ethylacrylates;

said difunctional monomers are selected from the group consisting of diacrylates and dimethacrylates;

said trifunctional monomers are selected from the group consisting of triacrylates and trimethacrylates;

said higher functionality monomers are selected from the group consisting of tetra- and pentaacrylates and pentaacrylate esters, aliphatic and aromatic acrylates; aromatic urethane acrylates and metallic acrylates;

said water dispersible monomers are selected from the group consisting of 2(2-ethoxyethoxy) ethylacrylate and polyethylene glycol diacrylates, and said adhesion promoting monomers are selected from the group consisting of acrylate esters and methacrylate esters.

47. The coated transfer sheet of claim 46, wherein said diacrylates and dimethacrylates are selected from the group consisting of tripropylene glycol diacrylate, bisphenol A diacrylates and ethoxylated bisphenol A dimethacrylates, and said triacrylates and trimethacrylates are selected from the group consisting of trimethylolpropane ethoxy triacrylate and trimethyl propane triacrylates.

48. The coated transfer sheet of claim 44, wherein said oligomer polymer resins are selected from the group consisting of aliphatic urethane acrylates; aliphatic urethane diacrylates; aliphatic urethane triacrylates; hexafunctional aliphatic urethane acrylates; hexafunctional aromatic urethane acrylates; trifunctional aromatic urethane acrylates, aromatic urethane acrylates; urethane methacrylates; epoxy acrylates; epoxy methacrylates; polybutadiene dimethylacrylates; diacrylates of bisphenol-A epoxy resins; modified bisphenol-A epoxy acrylate resins; novolac epoxy acrylates; modified epoxy acrylates; partially acrylated bisphenol-A epoxy resins; bisphenol-A epoxy diacrylates; polyester resins; cycloaliphatic epoxide resins; modified cycloaliphatic epoxides; aliphatic polyols; partially acrylated bisphenol-A epoxy resins; and cycloaliphatic diepoxides.

49. The coated transfer sheet of claim 48, wherein said polyester resins are selected from the group consisting of chlorinated polyester resins, modified polyester resins, polyester methacrylates, acrylated polyesters, modified polyester acrylates, modified polyester hexaacrylates, polyester tetracrylates, and hexafunctional polyester acrylates;

said cycloaliphatic epoxide resins is 3,4-epoxycyclohexyl-methyl-3,4,-epoxycyclohexane carboxylate; and said modified cycloaliphatic epoxides are selected from the group consisting of acrylate modified cycloaliphatic epoxides containing both acrylate and epoxy functionalities.

50. The coated transfer sheet of claim 33, wherein said barrier layer comprises an acrylic polymer.

51. The coated transfer sheet of claim 33, wherein said barrier layer comprises a styrene-butadiene resin.

52. The coated transfer sheet of claim 33, wherein said barrier layer comprises a polymer selected from the group consisting of: poly(dienes), poly(methacrylics), poly (acrylamides), poly(methacrylic acids), poly(vinyl ethers), poly(vinyl halides), poly(vinyl esters) and hydrolyzed or partially hydrolyzed versions thereof, poly(styrenes), poly (oxides), poly(carbonates), poly(esters), poly(anhydrides), poly(urethanes), poly(siloxanes), poly(sulfones), poly (sulfonamides), poly(amides) poly(imines), poly (benzimidazoles), and carbohydrates, and copolymers derived from any of the foregoing.

53. The coated transfer sheet of claim 33, wherein said barrier layer comprises a cycloaliphatic epoxide, optional cycloaliphatic epoxide resin, epoxy novolac resin, optional alcohol, activated epoxy, aryl ketone, optional polyacrylate, and optional polysiloxane.

54. The coated transfer sheet of claim 33, wherein said barrier layer is present in a dry coat amount of from 1 to 20 $g/m^2$; and said release layer is present in an amount of from 12 to 50 $g/m^2$.

55. The coated transfer sheet of claim 33, which further comprises an antistatic layer coated on said second surface of the substrate, wherein said antistatic layer comprises a quaternary ammonium salt solution.

56. The coated transfer sheet of claim 33, which further comprises an antistatic layer coated on said second surface of the substrate, wherein said antistatic layer comprises a polyether solution.

57. The coated transfer sheet of claim 1, further comprising an image layer, wherein said image layer further comprises an ethylene vinyl acetate copolymer powder.

58. The coated transfer sheet of claim 1, further comprising an image layer, wherein said image layer further comprises an oxidized polyethylene homopolymer.

59. The coated transfer sheet of claim 1, wherein said sheet does not contain a separate adhesive layer.

60. The coated transfer sheet of claim 1, wherein said release layer comprises:

a film forming binder;

a wax dispersion; and a retention aid.

61. A coated transfer sheet comprising:

a substrate having a first and second surface;

at least one barrier layer comprising a polymer selected from the group consisting of a thermosetting polymer, an ultraviolet curable polymer, and combinations thereof; and at least one release layer comprising a film forming binder overlaying said at least one barrier layer, wherein said release layer comprises a film-forming binder, an elastomeric emulsion, a water repellant and a plasticizer, and said film-forming binder is an acrylic dispersion, said water repellant is polyurethane dispersion and said plasticizer is a polyethylene glycol.

62. A coated transfer sheet comprising:

a substrate having a first and second surface;

at least one barrier layer comprising a polymer selected from the group consisting of a thermosetting polymer, an ultraviolet curable polymer, and combinations thereof; and at least one release layer comprising a film forming binder overlaying said at least one barrier layer, wherein the coated transfer sheet further comprises polyethylene glycol.

63. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer, and wherein the coated transfer sheet further comprises at least one silver halide light sensitive emulsion layer containing light sensitive silver halide grains.

64. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer, and wherein said release layer has light sensitive silver halide grains dispersed therein.

65. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer, and wherein the coated transfer sheet further comprises at least one layer of photosensitive microcapsules or at least one layer of photosensitive microcapsules and developer in the same layer or at least one layer of photosensitive microcapsules and developer in separate layers coated on the transfer sheet.

66. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer, and wherein the coated transfer sheet further comprises photosensitive microcapsules or photosensitive microcapsules and developer dispersed in the release layer.

67. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer, and wherein the coated transfer sheet further comprises at least one thermal recording layer coated on the surface of the transfer sheet, wherein said at least one thermal recording layer contains heat-responsive microcapsules capable of creating an image.

68. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer, and wherein said release layer further comprises heat-responsive microcapsules capable of creating an image.

69. A coated transfer sheet comprising:

a substrate having a first and second surface;

at least one barrier layer consisting essentially of a polymer selected from the group consisting of a thermosetting polymer, an ultraviolet curable polymer, and combinations thereof; and at least one release layer comprising a film forming binder and a plasticizer overlaying said at least one barrier layer, said release layer is capable of:

separating from the barrier layer, providing adhesion of the release layer to a receptor without a separate surface adhesive layer, and providing a colorfast image when transferred to a receptor.

70. A coated transfer sheet comprising:

a substrate having a first and second surface;

at least one barrier layer comprising a polymer selected from the group consisting of a thermosetting polymer, an ultraviolet curable polymer, and combinations thereof;

at least one release layer comprising a film forming binder overlaying said at least one barrier layer; and an antistatic layer on said second surface of the substrate.

71. A coated transfer sheet comprising:

a substrate having a first and second surface;

at least one barrier layer overlaying said first surface, wherein said barrier layer consisting essentially of a polymer selected from the group consisting of a thermosetting polymer, an ultraviolet curable polymer, and combinations thereof; and at least one release layer overlaying said at least one barrier layer, said release layer comprising:

a thermoplastic polymer which melts in a range of from about 65° C. to about 180° C. and has a solubility parameter less than about 19 $(Mpa)^{1/2}$; said release layer is capable of:

separating from the barrier layer, providing adhesion of the release layer to a receptor without a separate surface adhesive layer, and providing a colorfast image when transferred to a receptor; and optionally at least one image receiving layer overlaying said at least one release layer, said image receiving layer comprising an ethylene acrylic acid co-polymer dispersion, wherein said transfer sheet does not contain an image between said substrate and said release layer.

72. A coated transfer sheet comprising:

a substrate having a first and second surface;

at least one barrier layer overlaying said first surface, wherein said barrier layer consisting essentially of a polymer selected from the group consisting of a thermosetting polymer, an ultraviolet curable polymer, and combinations thereof; and at least one release layer overlaying said at least one barrier layer, said release layer comprising:

a thermoplastic polymer which has a solubility parameter less than about 19 $(Mpa)^{1/2}$;

said release layer is capable of:

separating from the barrier layer, providing adhesion of the release layer to a receptor without a separate surface adhesive layer, and providing a colorfast image when transferred to a receptor; and optionally at least one image receiving layer overlaying said at least one release layer, said image receiving layer comprising an ethylene acrylic acid co-polymer dispersion, wherein said transfer sheet does not contain an image between said substrate and said release layer.

73. A method of applying an image to a receptor element which comprises the steps of:

(i) imaging the coated transfer sheet of claim 1, 71, 61, 62, 63, 64, 65, 66, 67, 68, 69, 70 or 72, (ii) positioning the front surface of the transfer sheet against said receptor element, (iii) applying energy to the rear surface of the transfer sheet to transfer said image and release layer to said receptor element, (iv) optionally allowing the substrate to cool, and (v) removing the substrate and barrier layer from the receptor element.

74. The method of claim 73, wherein said imaging is provided by an electrostatic printer or copier.

75. The method of claim 73, wherein said imaging is provided by offset or screen printing.

76. The method of claim 73, wherein said imaging is provided by craft-type marking.

77. The method of claim 76, wherein said craft-type marking is selected from the group consisting of markers, crayons, paints or pens.

* * * * *